US011678704B2

(12) United States Patent
Braithwaite et al.

(10) Patent No.: US 11,678,704 B2
(45) **Date of Patent: *Jun. 20, 2023**

(54) SCRAPER GLOVE

(71) Applicants: Daryl Braithwaite, Fairview, TX (US); Jonathan Kyle Komenda, Liberty, UT (US)

(72) Inventors: Daryl Braithwaite, Fairview, TX (US); Jonathan Kyle Komenda, Liberty, UT (US)

(73) Assignee: D4 DAB LLC, Fairview, TX (US)

( * ) Notice: Subject to any disclaimer, the term of this patent is extended or adjusted under 35 U.S.C. 154(b) by 55 days.

This patent is subject to a terminal disclaimer.

(21) Appl. No.: 17/152,765

(22) Filed: Jan. 19, 2021

(65) Prior Publication Data

US 2021/0161225 A1 Jun. 3, 2021

Related U.S. Application Data

(63) Continuation-in-part of application No. 16/176,861, filed on Oct. 31, 2018, now Pat. No. 11,033,061.

(60) Provisional application No. 62/579,688, filed on Oct. 31, 2017.

(51) Int. Cl.
*A41D 19/00* (2006.01)
*A47L 25/00* (2006.01)

(52) U.S. Cl.
CPC ..... *A41D 19/0024* (2013.01); *A47L 25/00* (2013.01)

(58) Field of Classification Search
CPC ..... A41D 19/0024; A41D 19/0086; A41D 19/01; A47L 25/00
See application file for complete search history.

(56) References Cited

U.S. PATENT DOCUMENTS 183,375 A * 10/1876 Cutliff ..... A41D 19/01547 172/370
1,055,838 A * 3/1913 Torrance ..... A41D 19/01547 2/21
2,409,101 A * 10/1946 Brittingham ..... A01B 1/00 2/21
2,725,570 A * 12/1955 Penna ..... A41D 19/0013 2/163
2,954,832 A * 10/1960 Amato ..... A41D 19/01594 172/370
3,650,172 A * 3/1972 Osborne ..... G10D 3/173 84/322
3,927,595 A * 12/1975 Ferguson ..... A41D 13/087 84/322

(Continued)

*Primary Examiner* — Khaled Annis
(74) *Attorney, Agent, or Firm* — Komenda PLLC

(57) ABSTRACT

A scraper glove is provided and includes a glove body and a scraper element. The glove body is mitten-shaped and includes a thumb sleeve and a fingers sleeve. The scraper element is attached to an exterior surface of the fingers sleeve and includes a receptacle portion to accept one or more fingers of a user when positioned within the fingers sleeve, and a scraping portion extending from the receptacle portion and integrally connected to the receptacle portion. The scraping portion includes a scraping edge with one or more teeth, and the scraping edge is configured to scrape pulp of a plant-based medium to hollow-out the plant-based medium. The scraper element further includes a textured leverage point on an anterior external surface of the scraper element between an end of the receptacle portion and the scraping edge.

20 Claims, 23 Drawing Sheets

(56) References Cited

U.S. PATENT DOCUMENTS 4,149,601 A * 4/1979 Taylor ..... A41D 19/01594 30/298
4,748,711 A * 6/1988 Markus ..... A47L 1/16 15/236.08
4,867,246 A * 9/1989 Kiger ..... A41D 19/01594 172/370
5,014,792 A * 5/1991 Gierloff ..... A01B 1/06 172/378
5,323,677 A * 6/1994 Knutson ..... G10D 3/173 84/322
5,644,796 A * 7/1997 Laughlin ..... A41D 19/01594 2/163
5,687,424 A * 11/1997 Masley ..... A41D 19/01547 2/163
5,887,283 A * 3/1999 Mackay ..... A01B 1/00 2/163
6,058,510 A * 5/2000 Breitenbach ..... A41D 19/01594 2/163
6,061,830 A * 5/2000 Geller ..... A41D 19/0068 2/69
6,460,190 B1 * 10/2002 Blum ..... A47L 17/06 2/160
6,557,178 B1 * 5/2003 Hoover ..... B24D 15/045 2/160
7,375,268 B1 * 5/2008 Thornhill ..... G10D 3/173 84/322
8,502,053 B2 * 8/2013 Gustafson ..... G10D 3/173 84/322
8,856,966 B2 * 10/2014 Doty ..... A61H 7/003 2/163
8,955,166 B1 * 2/2015 Madden, Jr. ..... A41D 19/0024 2/160
D749,792 S * 2/2016 Visokey ..... D29/117.1
9,345,278 B2 * 5/2016 Crear ..... B26B 27/007
D821,697 S * 7/2018 Matalon ..... D2/617
10,188,162 B2 * 1/2019 Block ..... A41D 19/0086
11,033,061 B2 * 6/2021 Braithwaite ..... A41D 19/01594
11,399,660 B2 * 8/2022 Thompson ..... A47L 13/42
2005/0231471 A1 * 10/2005 Mallard ..... A41D 19/0024 345/156
2007/0118968 A1 * 5/2007 Doty ..... A61H 7/003 2/160
2007/0199167 A1 * 8/2007 Mason ..... A47L 13/022 15/245
2012/0317954 A1 * 12/2012 Landicini, Jr ..... A01D 7/00 56/400.01
2013/0061368 A1 * 3/2013 Filippone ..... A63B 71/143 2/160
2013/0291281 A1 * 11/2013 Lee ..... A41D 19/0024 2/163
2014/0047619 A1 * 2/2014 Singh ..... A41D 1/089 2/235
2016/0007663 A1 * 1/2016 Price ..... A41D 19/0024 2/160
2016/0081404 A1 * 3/2016 Visokey ..... A41D 13/087 2/21
2016/0100637 A1 * 4/2016 Anderson ..... A41D 19/0024 2/163
2017/0055605 A1 * 3/2017 Block ..... A41D 19/01594
2017/0352336 A1 * 12/2017 Dutton ..... G10D 3/173
2018/0249774 A1 * 9/2018 Ohanian ..... A41D 13/087
2020/0138132 A1 * 5/2020 Braithwaite ..... A41D 19/0086
2021/0161225 A1 * 6/2021 Braithwaite ..... A41D 19/01

* cited by examiner

SCRAPER GLOVE

RELATED APPLICATIONS

This application claims benefit as a continuation-in-part to U.S. patent application Ser. No. 16/176,861, filed Oct. 31, 2018, which claims the benefit of priority to U.S. Provisional Patent Application Ser. No. 62/579,688, filed Oct. 31, 2017, which is incorporated by reference herein in its entirety.

BACKGROUND

This disclosure relates in general to gloves and, more particularly, glove-based tools.

The holiday of Halloween is an important holiday in the United States and is becoming an increasingly popular celebration in many other parts of the world. To commemorate the autumn season, Halloween and other autumn celebrations make use of decorative pumpkins, gourds, and other fall fruit as decorations, activities, and novelties. Among the most popular uses of pumpkins and gourds is the carving of jack-o'-lanterns. Traditionally, jack-o'-lantern carving involves hollowing out the pumpkin by removing the flesh and seeds (collectively referred to herein as "pulp") from the inside of the pumpkin and carving an image into one or more sides of the pumpkin. Comical or scary faces and images are common images. The presentation of the pumpkin may be further enhanced by placing a light source, such as a traditional or electronic candle, into the hollow interior of the pumpkin and cause the image to glow. In recent years, the use of other species of fruits and vegetables have been used to construct jack-o'-lanterns and other arts and crafts, including melons and other examples.

BRIEF DESCRIPTION OF THE DRAWINGS

Like reference numbers and designations in the various drawings indicate like elements.

DETAILED DESCRIPTION

Given the rising popularity of Halloween, jack-o'-lantern carving, and other crafts, which make use of fruit and vegetable as media, an increasing and persistent interest in participating in such crafts exist. For some, one of the least pleasurable aspects of carving a jack-o'-lantern or other such craft is the preparation of the medium for carving of images or building sculptures from the hollowed-out shell of the pumpkins, melons, gourds, or other plant-based medium (referred to herein collectively as "plant-based medium"). For instance, in preparation of a pumpkin for carving as a jack-o'-lantern, users traditionally, cut an opening in the pumpkin and use their hands to empty the pumpkin of its pulp, followed by the use of a spoon or other scraping utensil to scrape away any remaining pulp. Almost inevitably, these preparation steps result in some of the liquid and pulp from within the plant-based medium's cavity to transfer to the skin or clothes of the user, as these scraping actions (with and without utensils) involve the user reaching their hand at least partially into the hollow cavity of the plant-based medium, among other example issues. Some users may be allergic to or find it undesirable to contact pulp and plant juice, discouraging such users from participating in such activities.

Figure 1A:
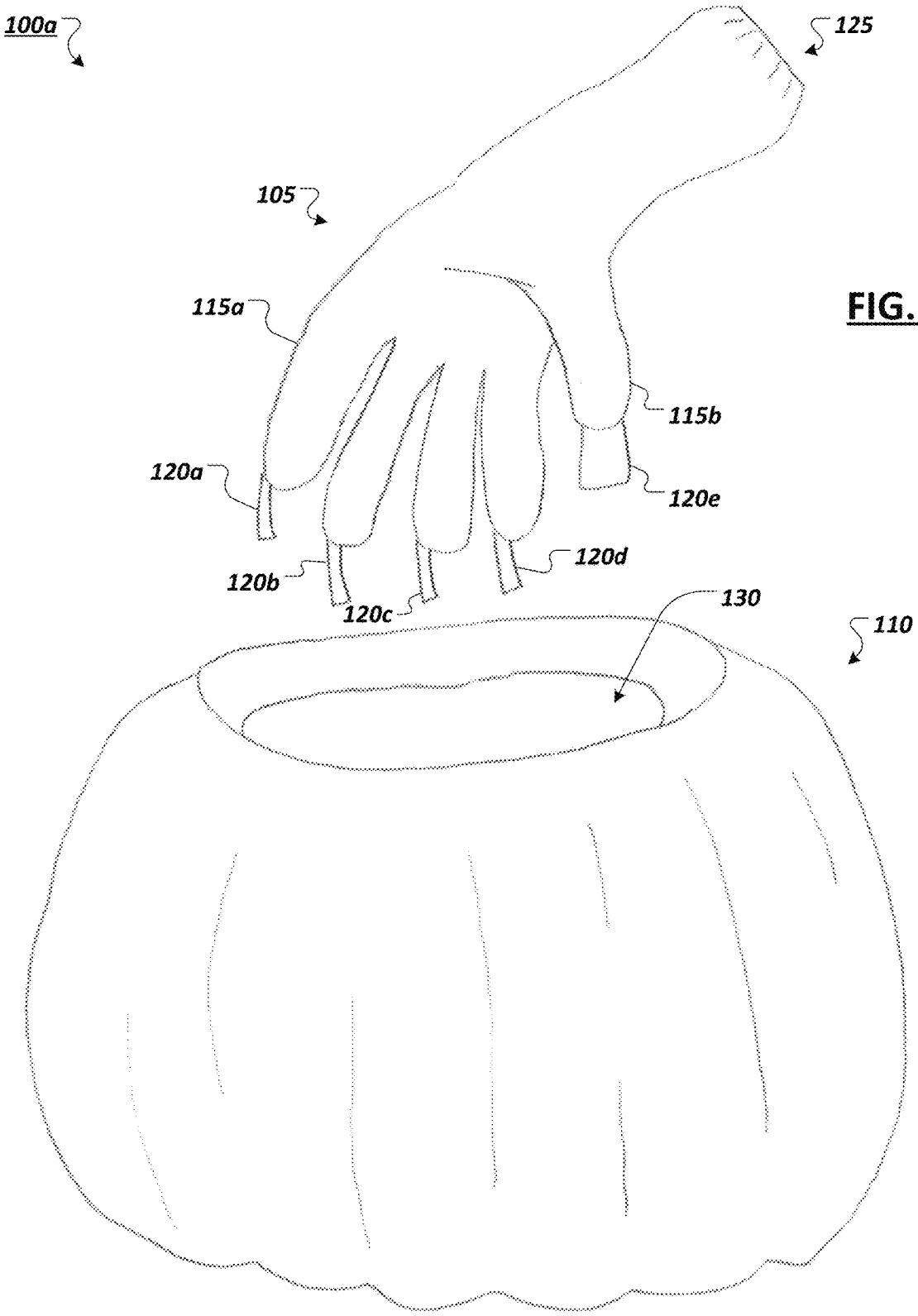
FIGS. 1A-1B are schematic diagrams showing the use of an example scraper glove to remove pulp from a pumpkin.
Figure 1B:
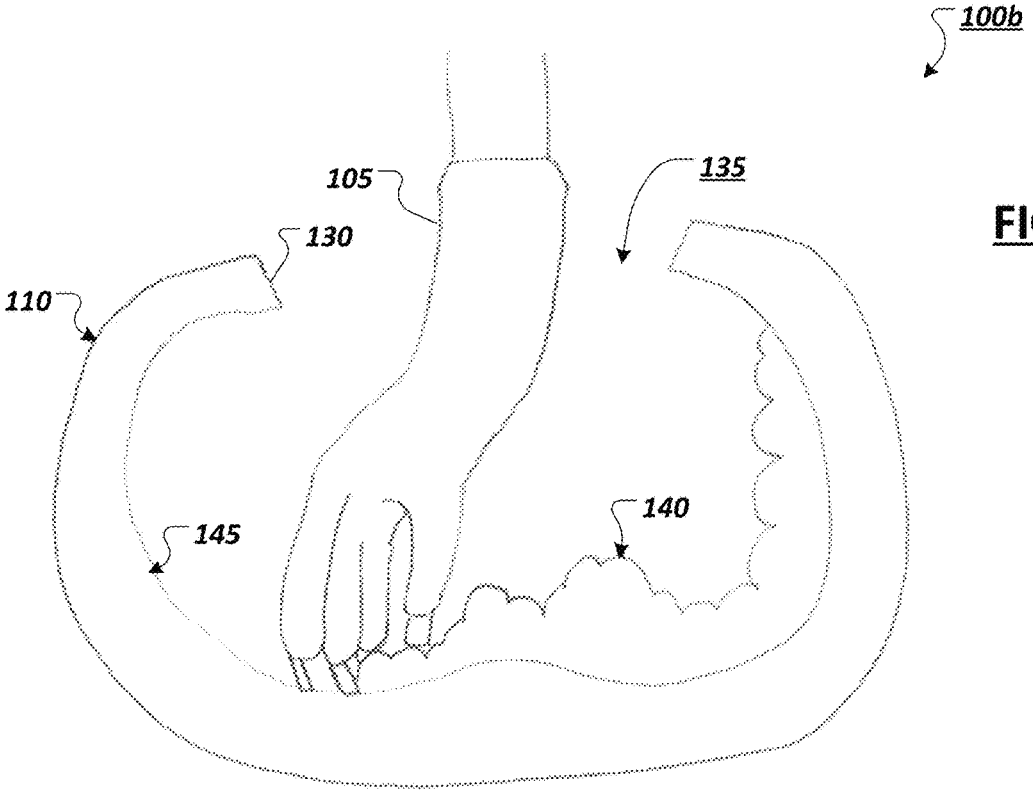

Turning to FIGS. 1A-1B, simplified illustrations 1000*a-b* are presented to illustrate an implementation of a scraper glove 105, which may be used to scrape and hollow-out the interior of a plant-based medium 110, such as a pumpkin, other gourd, melon, etc. Such hollowing-out may be performed in connection with preparing the plant-based medium for use in a craft project, such as the carving of a jack-'o-lantern. For instance, as shown in FIG. 1A, the scraper glove 105 may be provided with one or more finger sleeves (e.g., 115*a-b*) in which the fingers of a user may be inserted. At the ends of one or more of these finger sleeves, rigid scraper elements (e.g., 120*a-e*) may be provided, which may be reinforced within the finger sleeves to effectively extend the fingers and fingernails of the user to allow the user to scrape the interior of the plant-based medium of pulp the user desires to remove. This may allow the user the dexterity enjoyed when emptying the plant-based medium of pulp by hand, while providing the additional example benefits of attaching rigid scrapers to the user's hand and protecting the user's skin and clothing from contact with the plant-based medium's juice and pulp, among other example advantages. In some implementations, the opening 125 of the glove 105 may include an elastic band, a tie, or other closure, which may assist in securing the glove 105 to the user's arm and further protecting against plant-based material from entering the interior of the glove, among other example features and advantages.

Continuing with this example, a user, upon putting on the glove, may insert their now-gloved hand into the interior cavity of plant-based medium 110, for instance, through an opening 130 carved in the plant-based medium 110. As shown in the cross-sectional diagram of the plant-based medium 110 illustrated in FIG. 1B, the user may then perform a scraping and grabbing motion within the cavity 135 to scrape the interior sides of the plant-based medium and collect pulp 140 for removal from the cavity 135 (e.g., through opening 130).

Figure 2A:
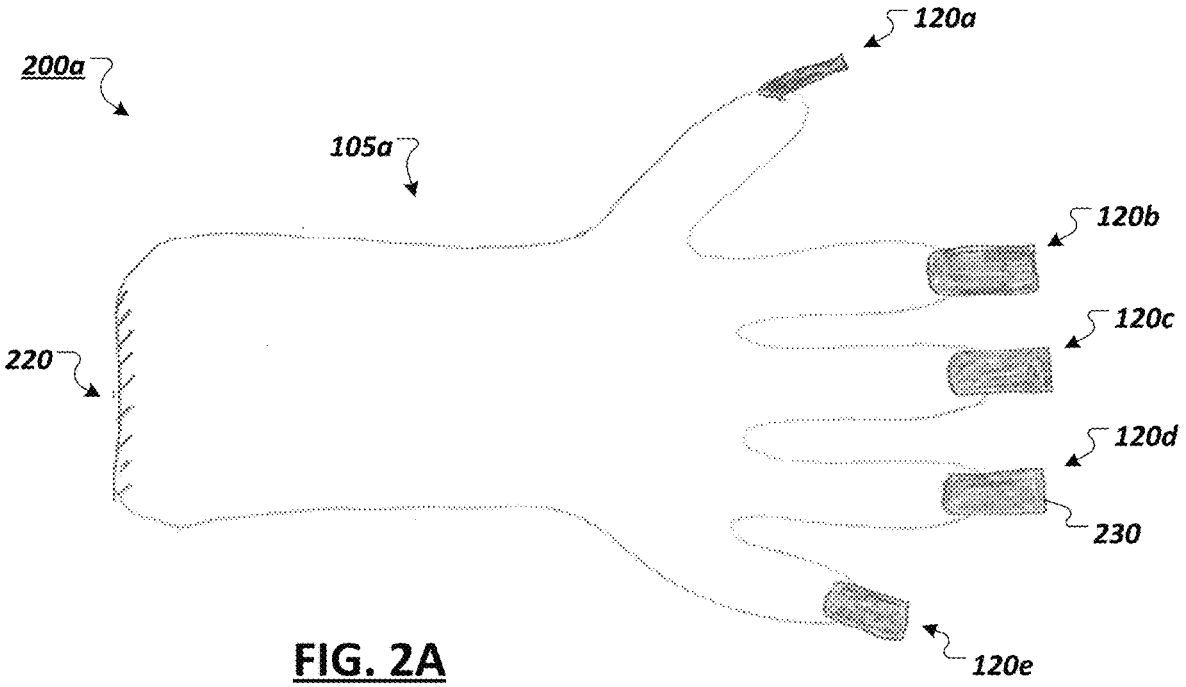
FIGS. 2A-2F are simplified diagrams of example scraper gloves.
Figure 2B:
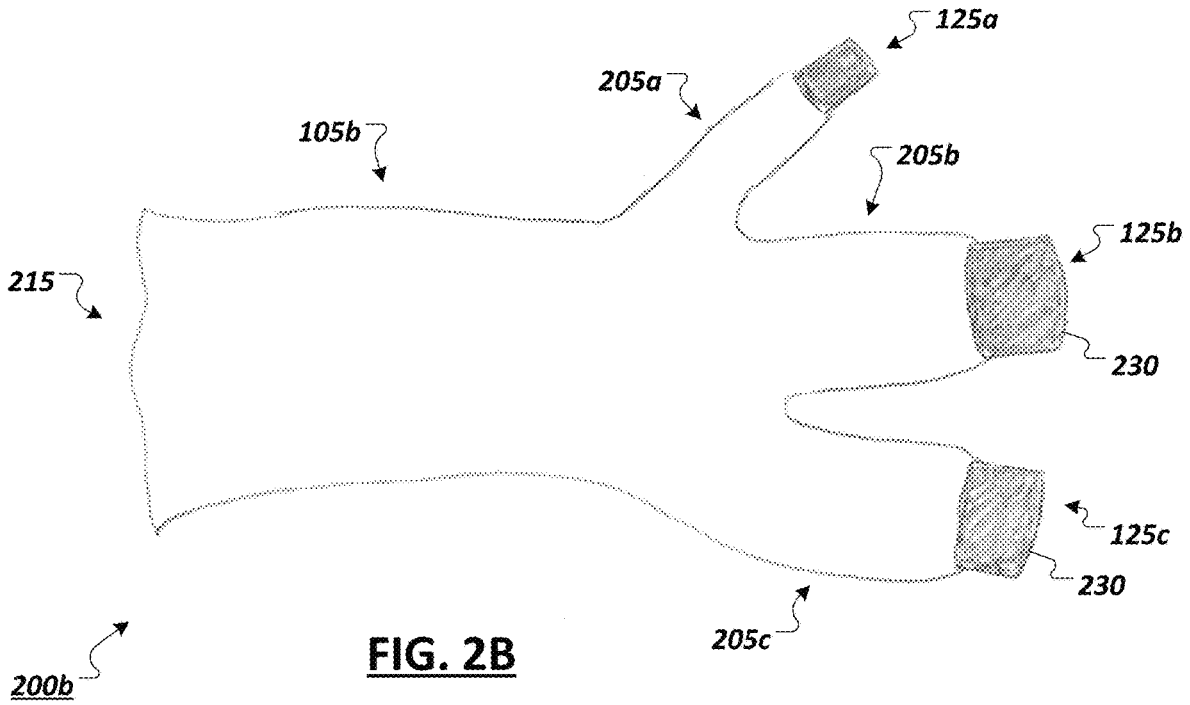

The diagrams 200*a-f* of FIGS. 2A-2F illustrate various alternative implementations of a scraper glove that includes at least one scraper element. For instance, as shown in the example of FIG. 2A, a scraper glove 105*a* according to a five-fingered implementation is provided, which includes five finger sleeves. In this example, each of the five finger sleeves may be provided with a corresponding scraper element (e.g., 120*a-e*), as in the example shown in FIGS. 1A-1B. Although each finger sleeve is shown with a corresponding scraper element, in some alternative examples, scraper elements may be omitted from one or more of the finger sleeves (e.g., omitted from the thumb or pinkie finger sleeves), among other examples. Turning to FIG. 2B, some implementations of a scraper glove (e.g., 105*b*) may provide for fewer than five finger sleeves. For instance, three finger sleeves (e.g., 205*a-c*) may be provided, each with a respective scraper element (e.g., 125*a-c*). In this example, the sleeves may be configured such that a first sleeve (e.g., 205*a*) is to accept the thumb of the user, a second sleeve (e.g., 205*b*) is to accept the pointer and middle fingers, and a third finger sleeve is to accept the ring and pinkie fingers. Other implementations may include finger sleeves configured for other combinations of fingers, such as a first sleeve for the thumb, a second for the pointer finger, and the third for the remaining fingers of the hand, or a first sleeve for the thumb, a second sleeve for the pointer, middle, and ring fingers, and the third sleeve for the pinkie finger, among other example implementations. Further shown in the example of FIG. 2B is an alternative glove opening 215, which may be included in some implementations of a scraper glove. While some implementation may include a glove opening (e.g., 220) that may be tightened or self-tighten (e.g., using a tie or elastic band) around the arm (e.g., upper or forearm) of the user, such a feature may be omitted in some implementations in favor of a simplified traditional glove opening, among other example features and embodiments. Further, scraper gloves can be implemented in various lengths. For instance, the sleeve of the glove may extend to the wrist, forearm, or the upper arm (e.g., above the elbow of the user), among other example lengths and implementations.

Figure 2C:
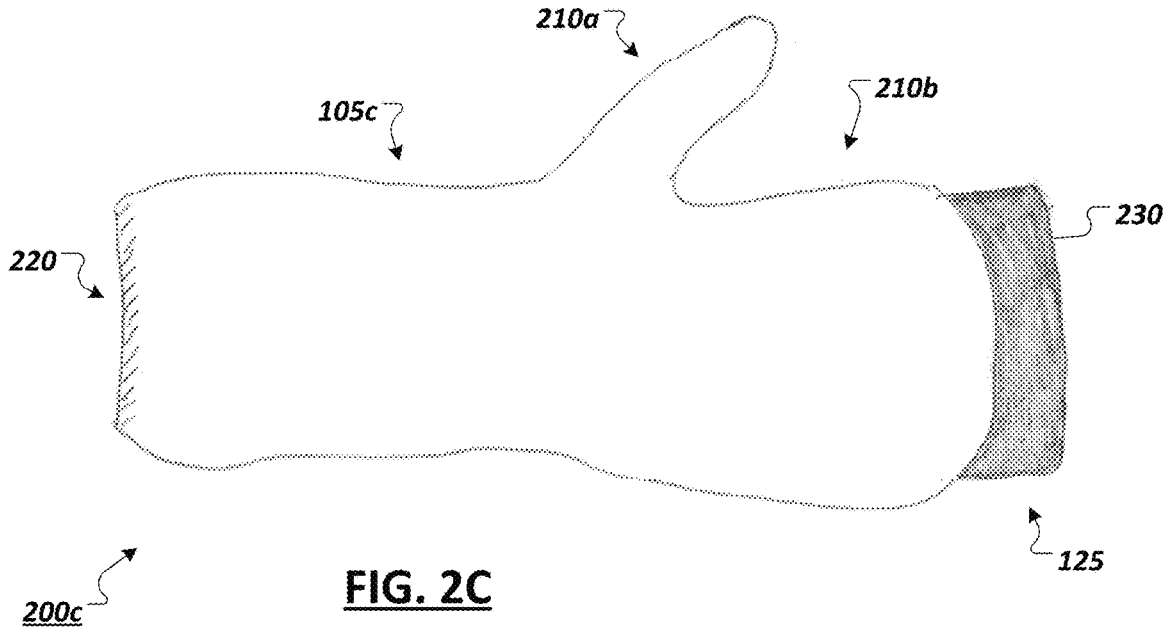
Figure 2D:
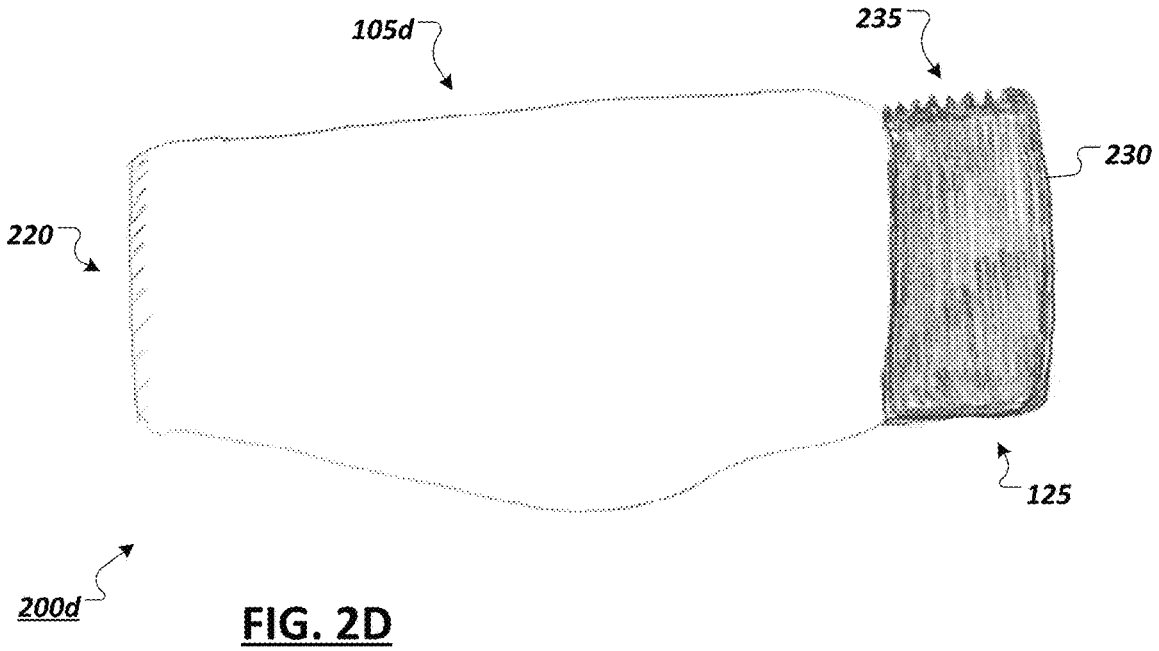

FIG. 2C shows yet another example of a scraper glove 105*c*, this implementation having two finger sleeves. For instance, a first finger sleeve 210*a* may be configured to house the thumb of the user, with the wider, second sleeve 210*b* configured to house the remaining fingers of the user. In some instances, such a configuration can allow for a larger scraping element 125 to be provided (on the end of the second sleeve 210*b*). Further illustrated in the example of FIG. 2C is the concept that implementations of a scraper glove (e.g., 105*c*) may omit scraper elements from at least some of the finger sleeves (e.g., 210*a*). FIG. 2D shows another example where a larger, unified scraper element 125 may be provided, similar to the example of FIG. 2C. In this example, the glove may allow several fingers to apply force and manipulate the scraper element 125. For instance, all fingers of the user, with the exception of the thumb, may principally control the scraper element 125, among other example implementations.

Figure 2E:
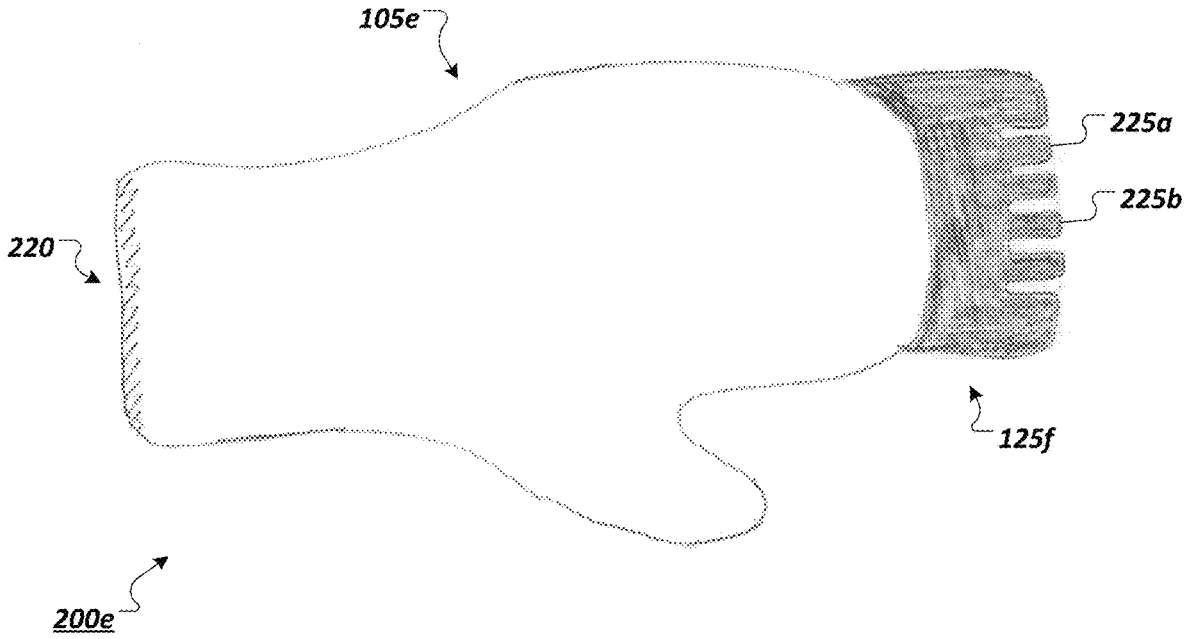

FIG. 2E is another example of a scraper glove 105*e*, which may include and support a large scraper element (e.g., 125*f*). While scraper elements in some implementations (e.g., as in the examples of FIGS. 2A-2D) may have a substantially flattened edge that is to come in contact with the plant-based medium and scrape surfaces of the medium, other implementations may provide for curved, jagged, or other geometries. For instance, in FIG. 2E, a pronged scraper element 125*f* is provided with one or more prongs (e.g., 225*a,b*), which may be used to enhance the scraper and collection of pulp from at least some varieties of plant-based media, among other examples and enhancement. For instance, one or more surfaces of a scraper glove may be textured, such as the scraper elements, exterior surfaces of the finger sleeves, exterior surfaces of the glove corresponding to the palm, knuckles, or other parts of the hand to enhance the grip of the glove, encourage the collection and gathering of slippery pulp materials, provide additional functionality in the glove (e.g., to smooth a surface of the medium using a roughened surface of the glove), among other example features. In some instances, such as in the example of FIG. 2D, the scraper element may be provided with a principle, or top, scraping edge (e.g., 230), as well as other edges (e.g., 235), which may also be used to scrape the medium or perform other work on the medium. As an example, a side edge 235 of the scraper element 125 shown in FIG. 2D may be serrated to allow the side of the scraper element 125 of the glove 105*d* to cut or saw the plant-based medium, among other example features.

Figure 3A:
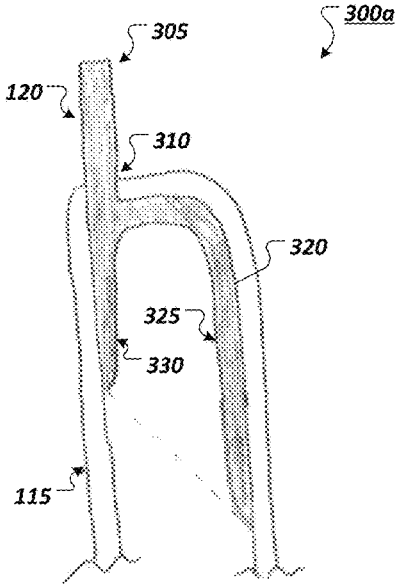
FIGS. 3A-3E are cross-sectional views of example finger sleeves and scraper elements of example scraper gloves.
Figure 3B:
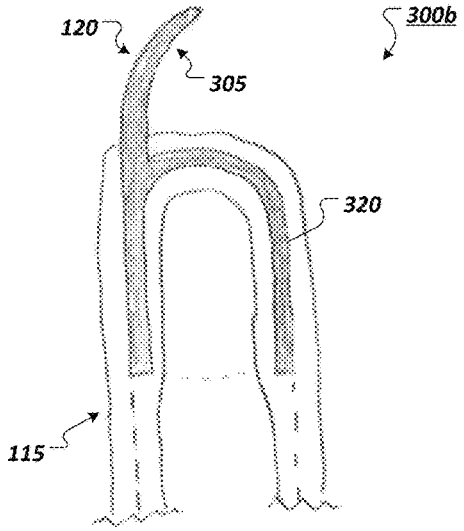

Turning to the diagrams 300*a-d* of FIGS. 3A-3D, cross-sectional views are shown of example finger sleeves 115 with embedded scraper elements 120. For instance, in FIG. 3A, a scraper element 120 is shown with a scraper portion 305*a* that is oriented as a substantially straight scraper extending from the tip of the finger sleeve. An opening 310 may be formed in the material of the finger sleeve, through which the scraper portion 305*a* of the scraper element 120 may extend. In some implementations, the scraper element 120 may additionally include a receptacle portion 320 into which at least the distal phalanx of the user's finger may be inserted to apply force to and control movement of the scraper element 120. In some instances, the receptacle portion 320 may be of a length to accept the entire finger of some users. As shown in the example of FIG. 3A (and the example of FIG. 3C, in some cases, the receptacle portion 320 may have an oblong opening to accommodate a receptacle shape which is longer on the side (e.g., 325) that is to come in contact with the palmar side of the user's finger, and shorter on the side (e.g., 330) of the scraper receptacle 320 that is to be proximate to the dorsal side of the finger when worn by the user. In such examples, providing additional receptacle length proximate to the palmar side of the user's finger(s) may allow additional leverage to be applied to the scraper element to enhance its utility. In other cases, such as shown in the example of FIG. 3B, the receptacle portion 320 may be uniform in length (e.g., with a substantially circular opening through which the user's finger(s) is to be received), among other example implementations.

Continuing with the example of FIG. 3B, scraper elements (e.g., 120) may not only differ in size and span (e.g., as illustrated in the examples of FIGS. 2A-2E), but different scraper glove embodiments may offer scraper elements with different shapes. For instance, as shown in the cross-sectional view 300*b* of the example scraper element of FIG. 3B, the tip or foremost edge 340 of the scraper element may be tapered or sharpened to enhance its scraping or carving functionality. The scraper element 120 in some instances, may be at least slightly curved (e.g., as in FIG. 3B) to promote scraping of some plant-based media, among other examples.

Figure 3E:
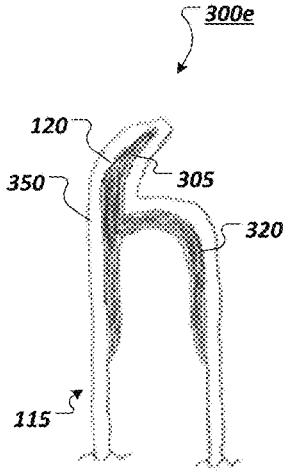

A scraper element may be attached to the finger sleeve of the glove during manufacture of the scraper glove. For instance, in the example of FIG. 3A, the scraper element may be passed through an opening 310 in the tip of the finger sleeve, with an adhesive being applied to the permanently bond and seal the scraper element to the glove. Heat bonding may be used in some implementations to connect scraper elements to the glove. In another example, the finger sleeves may be formed around the scraper element. For instance, the glove and finger sleeves may be manufactured using a liquid rubber material (e.g., latex, rubber) and constructed by depositing the liquid rubber on a mold, which may include the scraper elements. Accordingly, a scraper element may be dipped with a mold to cause the glove body to be formed over the exterior and/or interior surface(s) of the scraper elements. A combination of molding, heat bonding, and gluing may be performed to connect scraper elements to a glove body. In some cases, as shown in FIG. 3E, the glove material (e.g., 350) may be formed over and enclose the scraper element(s) (e.g., 120), among other example implementations and manufacturing techniques. For instance, as shown in FIG. 3B, the interior of the rigid scraper element receptacle may be coated and enclosed in the elastomeric material used for the glove. In some implementations, the base of the glove body may be dipped to deposit the liquid rubber material on the mold. Thereafter, scraper elements may be placed or adhered to the finger tips on the mold. In some instances, the mold, with the scraper elements, may be re-dipped to fasten the scraper elements to the glove body and facilitate a water tight seal. In some instances, where the mold is "double dipped" in the liquid rubber material to strengthen the attachment of the scraper elements to the glove, to limit the thickness and material use, only a portion of the mold may be dipped in the first dip to form only a portion of the overall glove body (e.g., the fingers or finger tips whereon the scraper elements will be deposited), with the entire mold be re-dipped once the scraper elements are attached, among other example manufacturing techniques and processes.

Figure 3C:
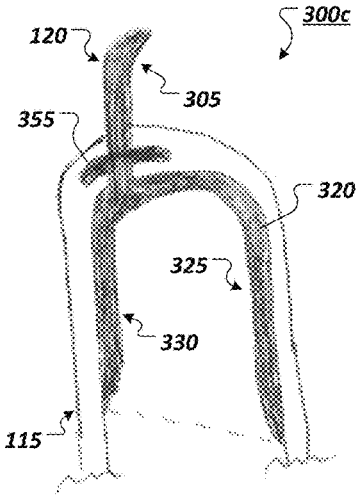
Figure 3D:
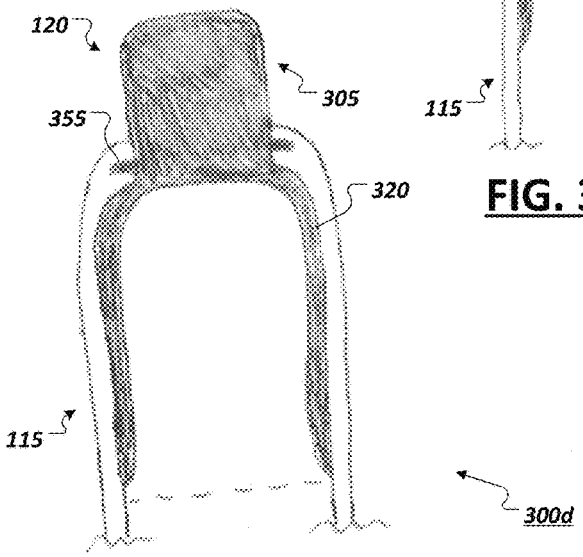

In some instances, the glove finger sleeves may be formed to interlock with the scraper elements to attach the scraper elements to the finger sleeves. For instance, as shown in the example of FIGS. 3C-3D, the scraper element 120 may be provided with a lip 355 (e.g., on the scraper portion and/or receptacle portion) which is designed to mate with a recess (e.g., 360) formed in the material of the finger sleeve. FIG. 3C shows a side cross-sectional view of such an implementation, with FIG. 3D showing a corresponding front cross-sectional view. Alternatively, the material of the finger sleeve may be provided with a lip, and the scraper element 120 may have the corresponding recess to accept the lip. In such instances, construction of the scraper glove may include inserting scraper element pieces up through the finger sleeve to cause at least a portion of the scraper portion (e.g., 320) to pass through an opening in the finger sleeve and cause the lip 355 to interlock with the recess. In some instances, the attachment of the scraper element to the finger sleeve may be enhanced by adhering the scraper element to the finger sleeve. In other instances, the glove may be formed around the scraper element, with the lip 355 serving to structurally reinforce the scraper element's attachment to the finger sleeve, among other example implementations.

Figure 4A:
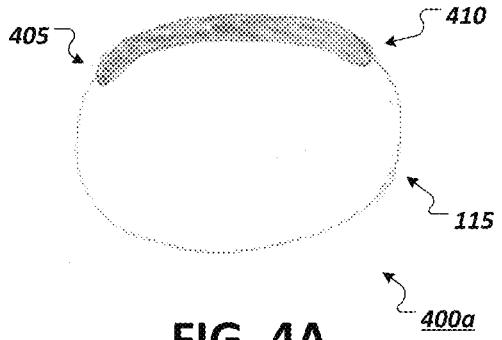
FIGS. 4A-4B are top views of example scraper elements connected to finger sleeves of example scraper gloves.
Figure 4B:
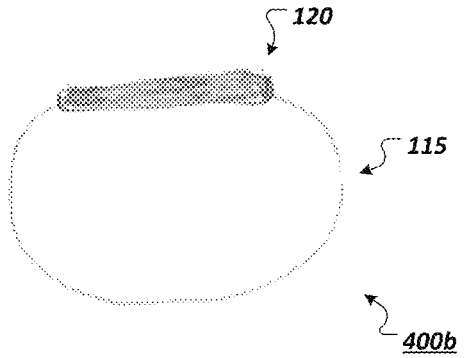

Turning to the examples of FIGS. 4A-4B, top views 400*a-b* are shown of example scraper elements attached to finger sleeves of example scraper gloves. The top view, in this context, refers to the view of the top of the finger sleeve (i.e., with the fingertips of the finger sleeves pointing toward the viewer). For the top view, the geometry of some example scraper elements can be observed, specifically the shape of the top scraping edge (e.g., 230) of the scraper element. For instance, in FIG. 4A, an example scraper element 120*a* is presented which curves at the ends (e.g., 405, 410) of the scraping edge. This can assist, in some implementations, in gathering pulp scraped from the plant-based medium. Alternatively, as shown in FIG. 4B, the scraping edge may be substantially straight or linear in dimension, among other scraping edge profiles (e.g., as shown in the examples of FIGS. 5A-6D).

Figure 5D:
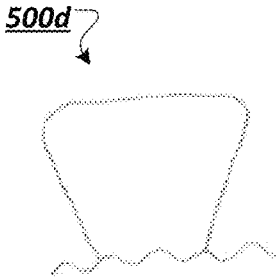
FIGS. 5A-5F are front views of scraping portions of example scraper elements for inclusion in example scraper gloves.
Figure 5E:
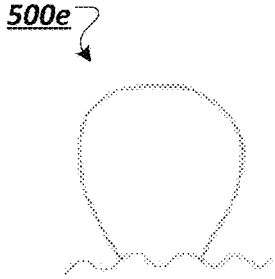
Figure 5F:
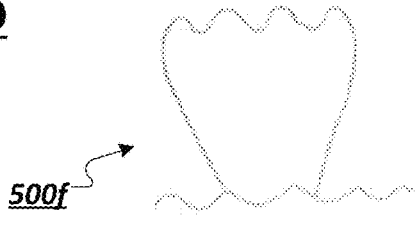
Figure 5A:
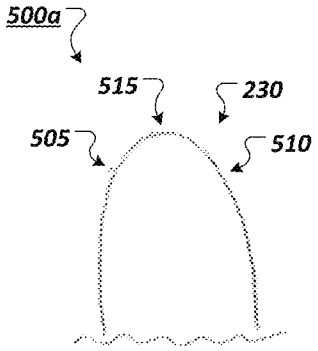
Figure 5B:
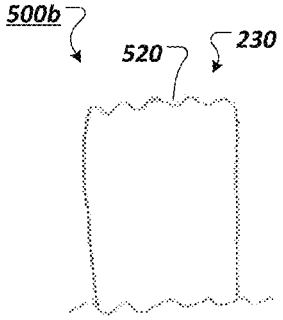

Turning to FIGS. 5A-5F, front views 500*a-f* of example scraper elements of a scraper glove are shown. FIGS. 5A-5F show other views of the geometry that may adopted in some scraper element designs. For instance, in FIG. 5A, a spade-like scraping edge 230 is shown, with the ends 505, 510 tapered down from the tip 515 of the scraping edge. FIG. 5B shows another example scraping edge design, in this instance, with a scalloped or serrated edge 520 (e.g., to enhance the scraping functionality of the scraping edge). In yet another example, shown in FIG. 5C, a substantially straight or linear scraper profile is shown, among other examples. Indeed, it should be appreciated that the various features described herein may be combined and sub-combined to implement a variety of different embodiments without departing from the more general principles and solutions descried herein. As an example, a scraper element may have a geometry that is linear when viewed from the top (e.g., such as in FIG. 4B), is tapered or spade-like when viewed from the front (or back) (e.g., as in FIG. 5A), and curved when viewed from the side (e.g., as in FIG. 3A), among other example configurations.

Figure 2F:
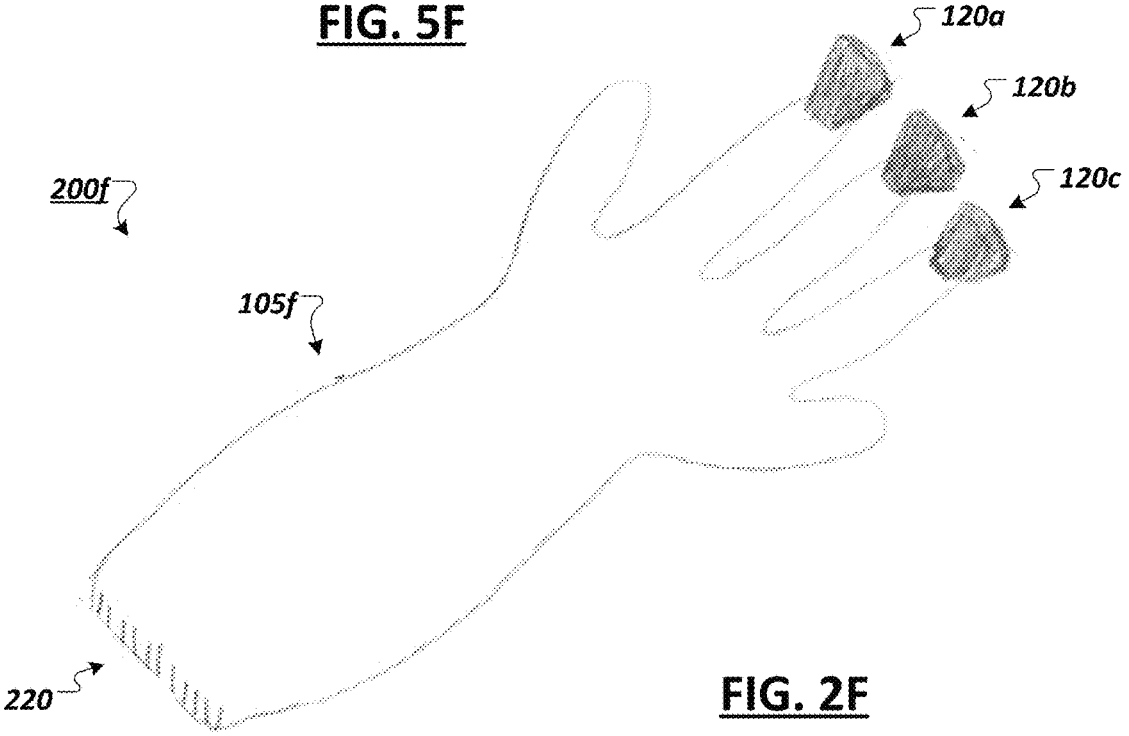
Figure 5C:
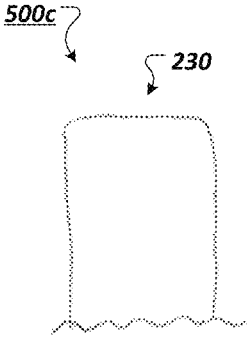

While the examples of FIGS. 5A-5C show scraper elements with substantially even geometries where the base of the scraper element (e.g., the portion of the scraper element lowest on the finger) is approximately the same width as the scraping edge of the scraper element, in other instances, the geometries of one or more scraper elements may be uneven in that the width of the base of the scraper element is substantially larger or smaller than the width of the scraping edge. For instance, FIGS. 5D-5F show example scraper elements with uneven, flared geometries, such that the scraping edges of the scraper elements are wider than their respective bases. Flared scraper elements, such as those illustrated in the examples of FIGS. 5D-5F, may facilitate a wider scooping or scraping platform and enable more efficient scraping through use of the scraper glove in some instances. FIG. 2F shows an example scraper glove 105*f* that incorporates flared scraper elements 120*a-c*. The example of FIG. 2F also shows that, in some instances, the number of scraper elements attached to the glove may be fewer than the number of finger sleeves incorporated in the glove.

Figure 6B:
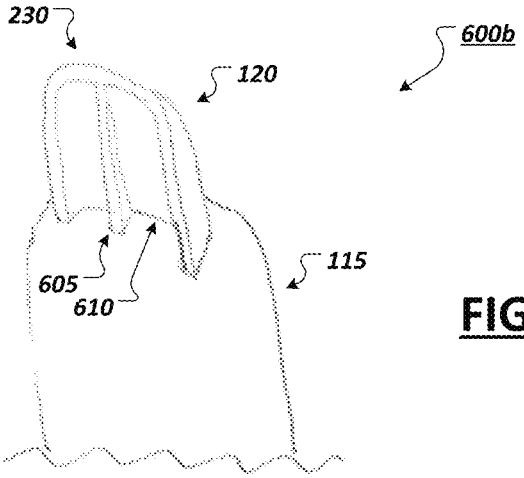
FIGS. 6A-6D are perspective views of example scraper elements connected to finger sleeves of example scraper gloves.
Figure 6D:
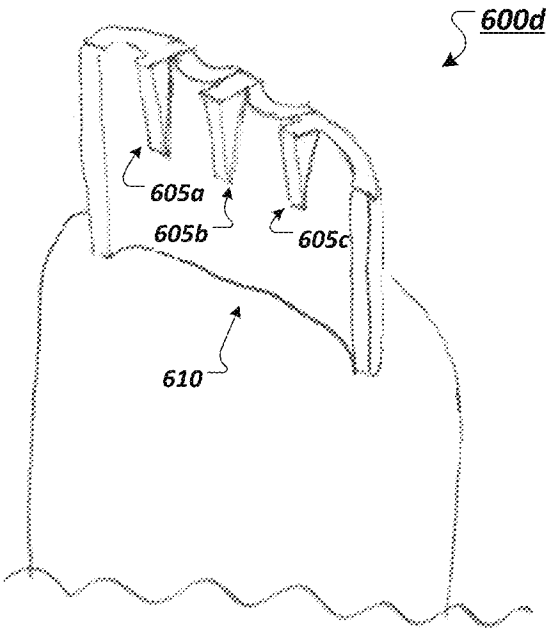
Figure 6C:
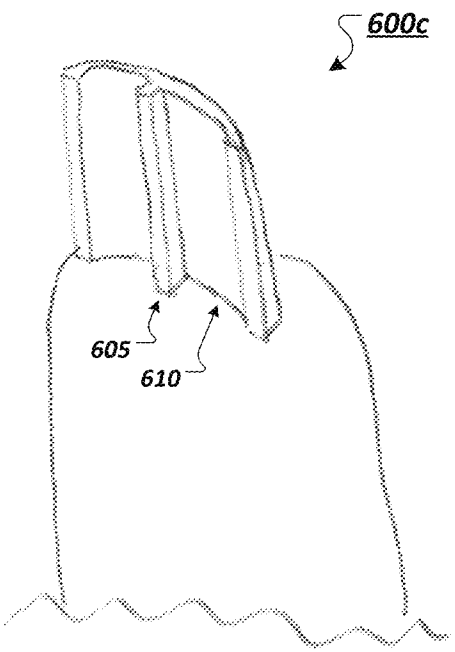
Figure 6A:
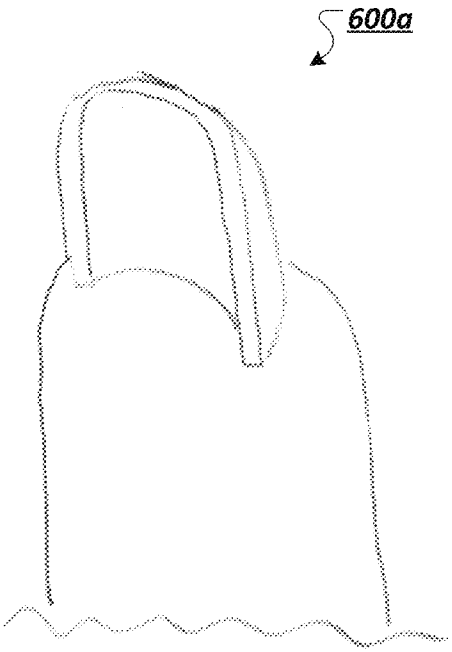

FIGS. 6A-6D illustrate perspective views of example scraper elements, which may be attached to an example finger sleeve 115 of a scraper glove. For instance, FIG. 6A illustrates a first example implementation of a scraper element 120. FIG. 6B illustrates another example scraper element, similar to the design in FIG. 6A, but with a rib member 605 running from the base 610 of the finger sleeve tip (i.e., the base 610 corresponding to the point at which the scraper element emerges from or joins the tip of the finger sleeve) and tapering until it meets flush with the scraping edge 230 of the remaining scraping portion of the scraper element. The rib member 605 may provide additional structural support and stability to the scraper element during scraping and may even enhance scraping and collection of pulp, as the rib protrudes from the front surface of the scraping portion and may provide a raking function during scraping. Additionally, as shown in the example of FIG. 6C, protrusion of an example rib member 605 may include protrusion from or near the scraping edge of the scraper element to enhance scraping and raking functionality provided through the scraper element. Still further, as shown in the example of FIG. 6D, multiple ribs may be provided on a single scraper element. In some cases, a serrated or scalloped scraping edge design may be combined with and correspond to multiple ribs provided on the scraping element, as shown in the example of FIG. 6E. Indeed, as noted above, features discussed above and illustrated in the figures of this disclosure may be combined in a variety of different embodiments. For instance, in the example of FIG. 6B, the scraper element may have a curved base 610 (with a cross-section resembling the curved scraper element of FIG. 4A), which tapers up to form a substantially linear scraping edge 230 and includes a rib 605 that similarly tapers from the base 610 to the top scraping edge 230. Indeed, As shown in the example of FIGS. 6D-6E, in implementations including one or more rib elements in the scraping portion of a scraper element, ribs may be implemented with a variety of different geometries. For instance, in FIG. 6D, the rib 605 runs the entire span from the base 610 to the scraping edge 230 of the scraper element, protruding substantially uniformly throughout the span of the rib. In other implementations, the rib may protrude at the top scraping edge, but taper down to protrude less or not at all at other points between the scraping edge 230 and the base 610. Indeed, in some cases, a mix of different ribs may be provided in scraper elements of the same scraper glove or even on the same scraper element (where multiple ribs are provided), among other example implementations. Accordingly, it should be appreciated that while some of scraper glove features are illustrated and described herein in an isolated and focused manor, this is only for convenience in describing each of these features. Scraper gloves, as presented herein, may incorporate potentially any combination of the features discussed herein, including gloves with scraper elements of uniform or non-uniform design, among other example features and sub-features.

Figure 7A:
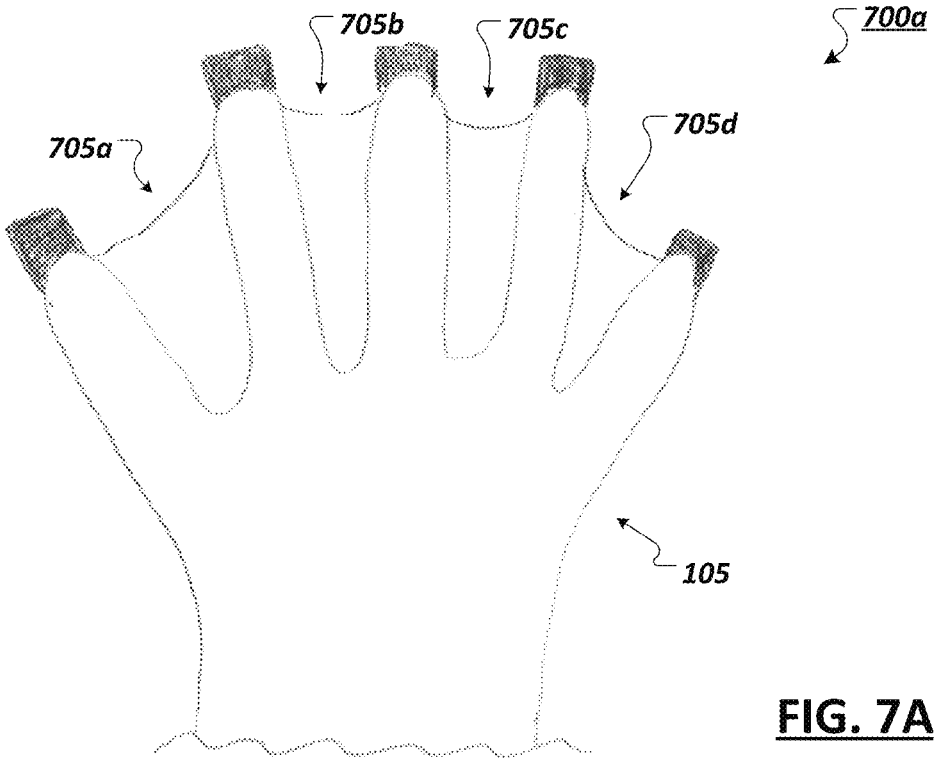
FIGS. 7A-7C are diagrams of example scraper gloves including webbing sections.
Figure 7B:
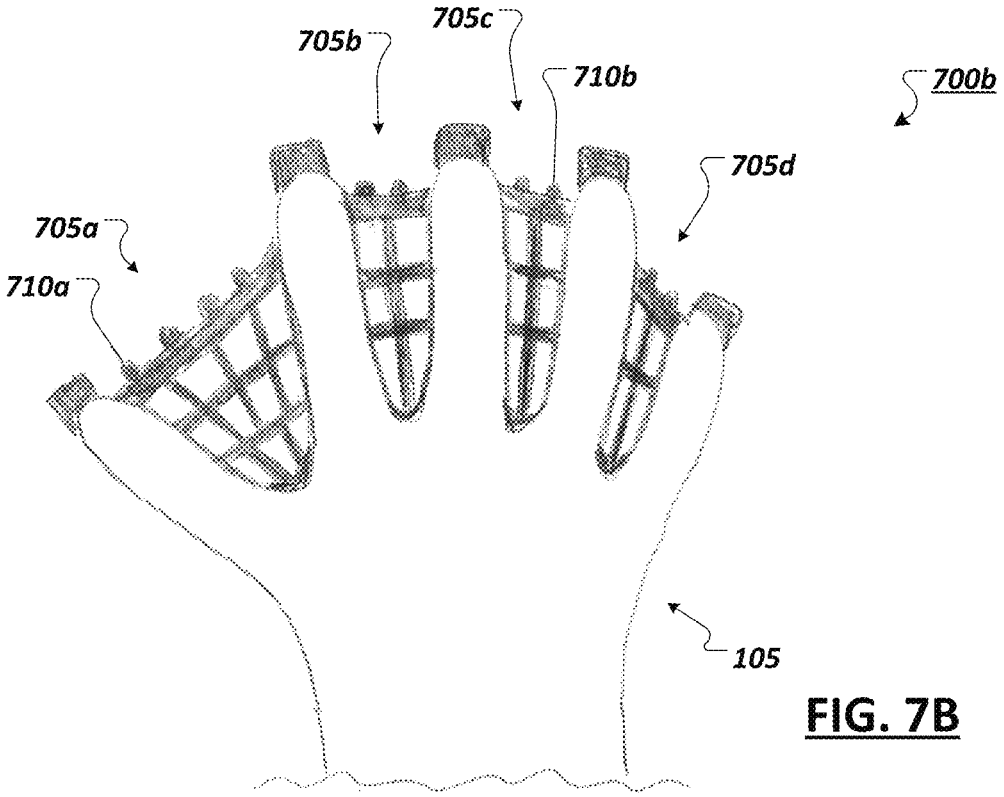
Figure 7C:
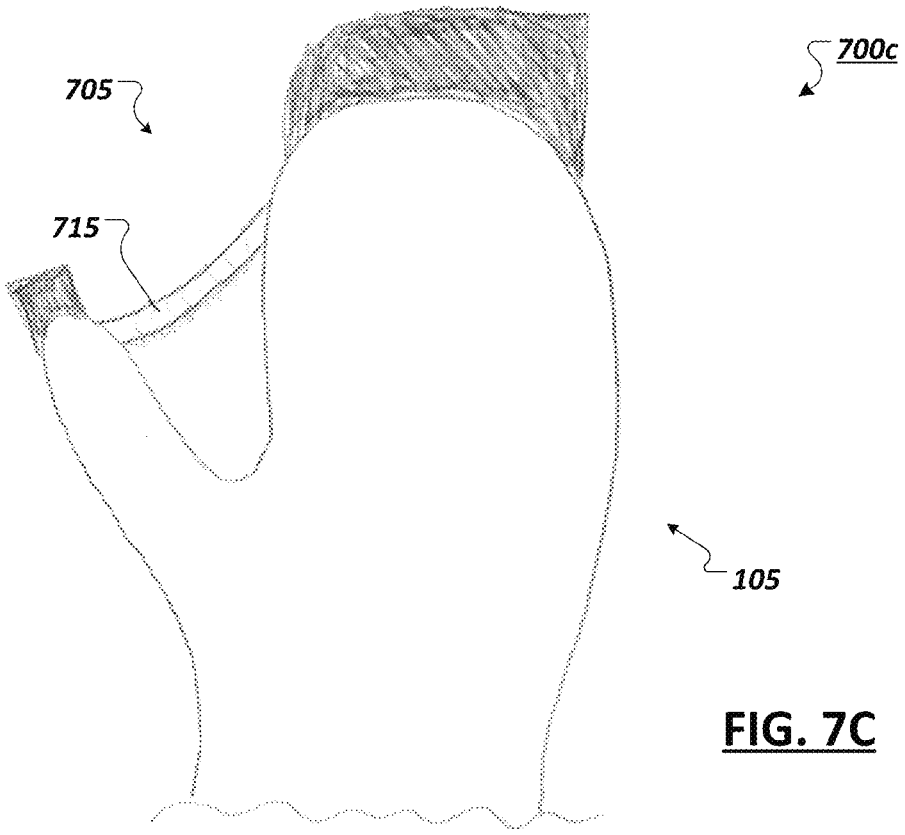

Turning to the diagrams 700*a-c* of FIGS. 7A-7C, in some implementations, a scraper glove may include webbing between one or more pairs of finger sleeves. FIG. 7A is a diagram 700*a* showing an implementation of a five-fingered implementation, with webbing (e.g., 705*a-d*) between and connecting each of the adjacent finger sleeves. The webbing may assist in trapping pulp scraped from a plant-based medium using the scraper glove 105. In some cases, the webbing may be formed integrally from the same material as the finger sleeves of the glove. In other instances, another material (more or less rigid or elastic than the glove material) may be utilized for the webbing. As shown in the example of FIG. 7B, in some implementations, the webbing (e.g., 705*a-d*) may be implemented to form a mesh- or net-like webbing to capture larger pulp solids but allow some liquids to escape (e.g., through the openings in the webbing). As further shown in the example of FIG. 7B, protrusions (e.g., 710*a-b*) may be provided on the top of some of the webbing sections to allow the webbing sections to assist in scraping of the medium. In other instances, protrusions may be added to the front surface of the webbing sections. For instance, as shown in the example of FIG. 7C, a lip 715 may be provided along the top of webbing 705 to assist in trapping pulp scraped by the scraping members and collected in the webbing of an example scraper glove. As further shown in the example of FIG. 7C, webbing may be provided in scraper glove implementations including fewer than five finger sleeves. Further, webbing elements may only be provided between some neighboring pairs of the finger sleeves, while be omitted from others, among other example implementations.

In some implementations, scraper gloves may incorporate aesthetic enhancements, including imaging and molding added to the body of the glove and finger sleeves, as well as the scraper element to allow the scraper gloves to resemble popular costume gloves. For instance, a scraper glove may be enhanced to resemble the hand of a skeleton, zombie, werewolf, or other Halloween theme or character. Indeed, while scraping elements may be implemented primarily for their utility in scraping a plant-based medium, such as the inside of a pumpkin (e.g., in preparation for jack-'o-lantern carving, the coloring and shape of the scraper elements may be enhanced according to a them (e.g., with individual scraper elements shaped and colored to resemble fingernails of a monster). The number of finger sleeves may also be adapted in some designs to accommodate certain novelty designs. For instance, a three-fingered sleeve design may be utilized to implement a scraper glove designed to resemble the hand of a mutant reptile character, among other fun and engaging aesthetic enhancements, which would not otherwise detract from the utility of the scraper elements or the larger scraper glove itself.

Figure 8:
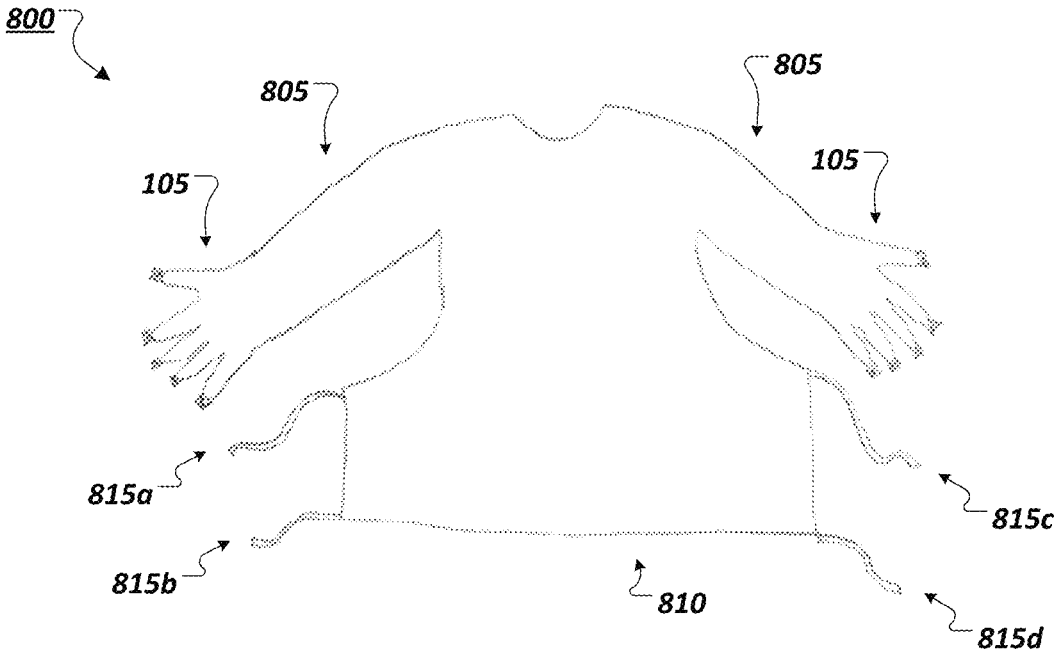
FIG. 8 is a simplified diagram illustrating example scraper gloves connected to an apron in accordance with at least one embodiment.

Additionally, in some implementations, such as shown in the diagram 800 of FIG. 8, scraper gloves may be connected to an apron, which may serve the dual purpose of offering further protection from pulp and juices contacting or staining clothing, but also to enhance themed scraper glove designs. For instance, the scraper glove 105 may be augmented to resemble a witch's hand, with the sleeve 805 and apron 810 portions printed or otherwise styled to resemble the witch's arms and clothing. Indeed, a variety of themes and designs may be adopted to further enhance the fun and attraction of using the scraper glove 105 in connection with holiday or other crafts, among other example features. Implementations integrating scraper gloves with an apron may include ties (e.g., 815*a-d*) or other attachment mechanisms (e.g., snaps, Velcro, buttons, zippers, etc.) to wrap the apron around the torso of the user and secure the apron to the user, among other example features.

Figure 9:
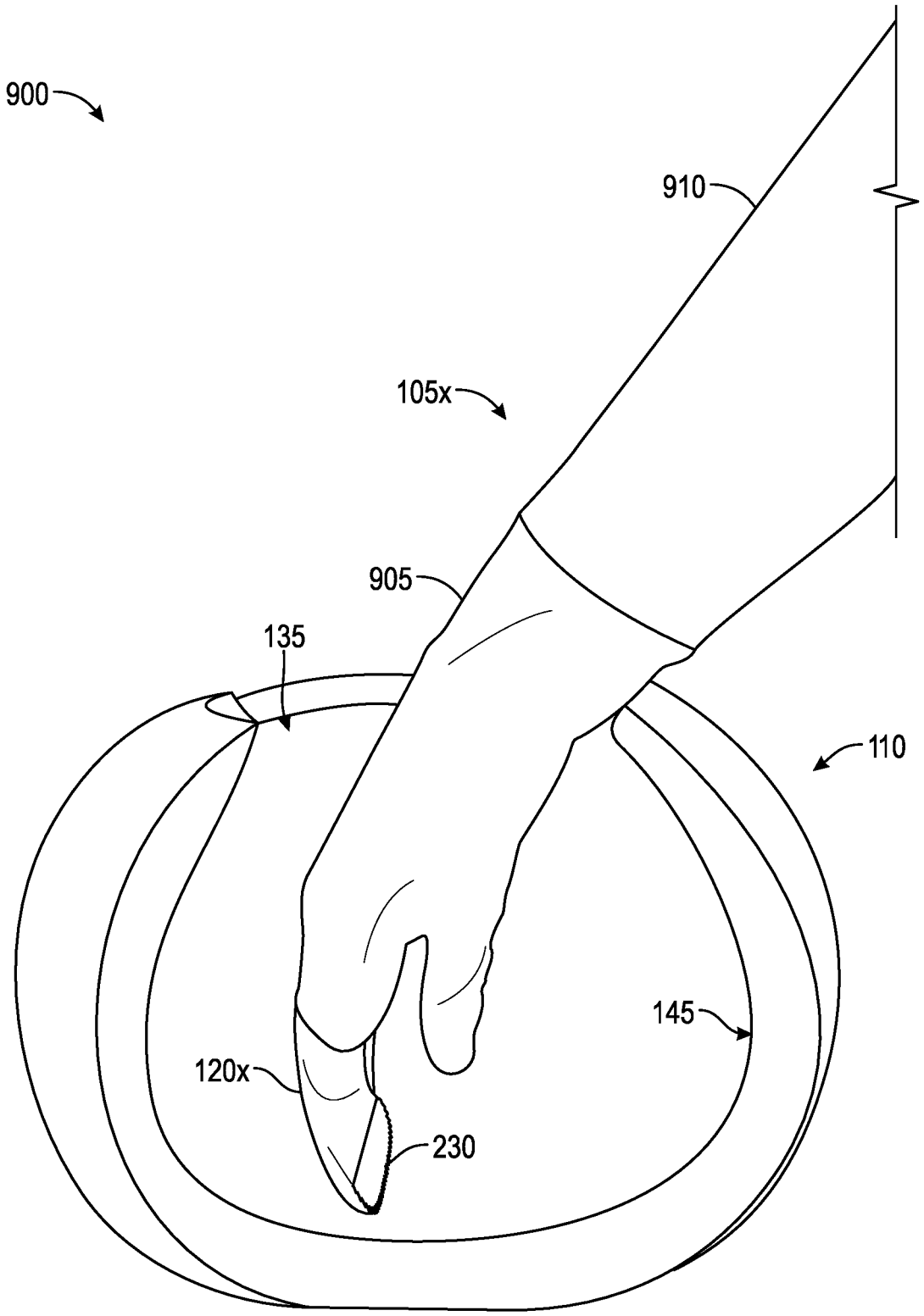
FIG. 9 is an illustration of the use of another example scraper glove to remove pulp from a pumpkin.

FIG. 9 is an illustration 900 showing the example use of an embodiment of a scraper glove 105*x* incorporating features such as discussed above. For instance, a single scraper element 120*x* may be provided (similar to the example shown in FIG. 2C), which accepts and is controlled using two or more fingers of a user wearing the scraper glove, while the thumb is left without an attached scraper element (e.g., to allow the user more dexterity in collecting or securing pulp and seeds removed or loosened by the scraper element (e.g., 120*x*) engaging with the inner surface 145 of a pumpkin or gourd 110. The scraper glove 105*x* may additionally include a glove portion 905 and a sleeve portion 910, allowing a user to reach into an opening 135 (e.g., earlier carved by a user) of the pumpkin 110 and maneuver within the pumpkin without potentially causing the juice or pulp of the pumpkin to touch the forearm or upper arm of the user (e.g., to protect the user's shirt sleeve from being stained or otherwise prevent contact of the user's skin with the pulp, etc.). In some implementations, the sleeve section 910 may be formed from a material different from that used to form the glove portion 905. For instance, while the glove portion 905 may be configured to fit substantially snuggly and possess elastomeric properties to enable a user to retain the dexterity of their fingers, thumb, and wrist, etc., the primary function of the sleeve portion 910 may be to provide a waterproof barrier and may fit more loosely and of a material that is more easily rolled up, for instance, to facilitate varying sizes of users' hands and arms, among other example functions and advantages.

In the example of FIG. 9, as introduced above, implementations of a scraper glove (e.g., 105*x*), the scraper element 120*x* may be attached to an outer surface of the glove section 905, for instance, by inserting an end of the glove section 905 within an inner cavity of the scraper element and securing the scraper element 120*x* to the exterior of the glove through an adhesive or bonding process, among other examples. This may lend enhanced structural integrity to the scraper glove at both the scraper element and the end of the glove section, among other example functions and advantages.

Figure 10A:
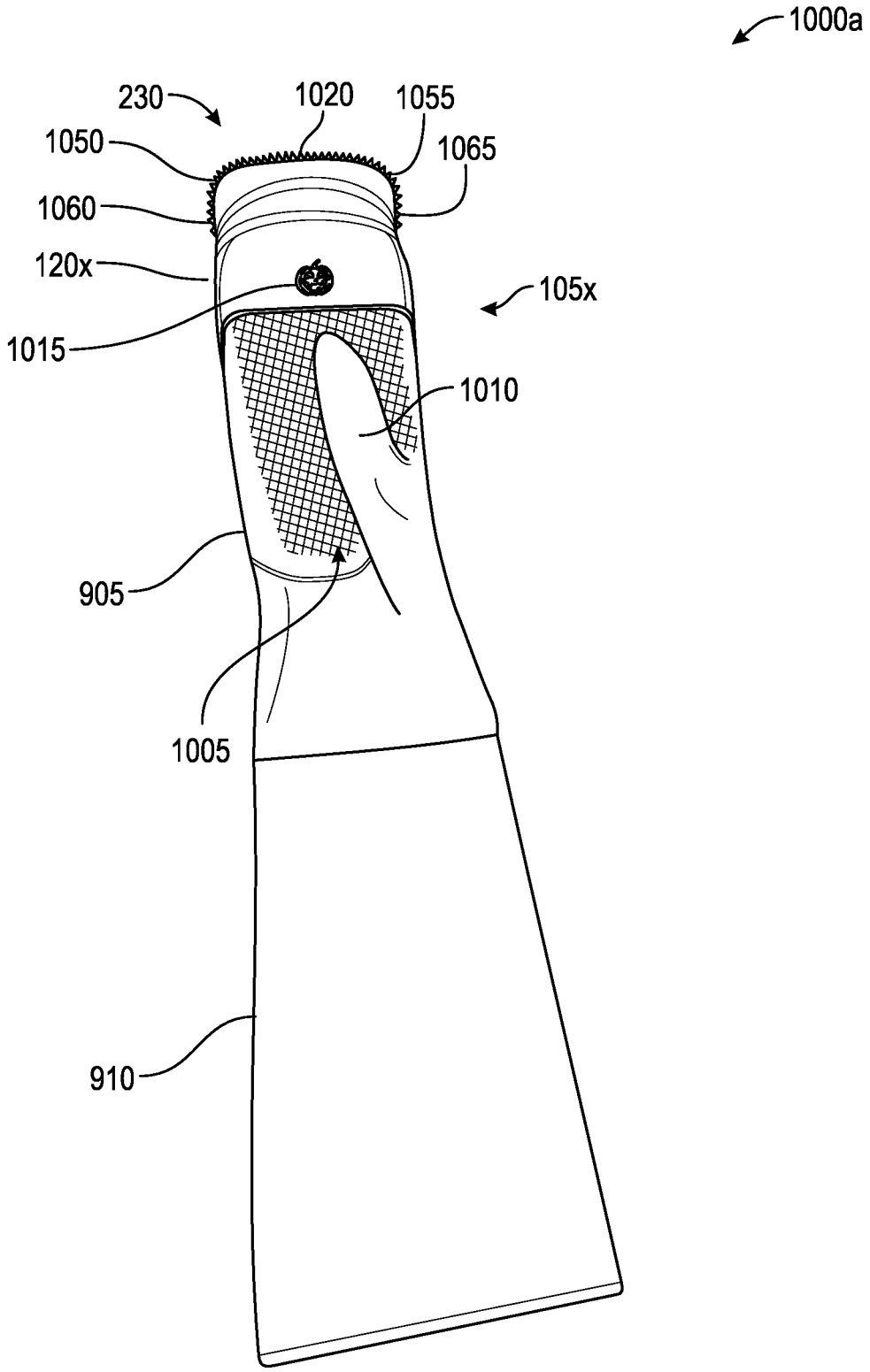
FIGS. 10A-10G illustrate views of the example scraper glove illustrated in FIG. 9.

Turning to the illustrations 1000*a-g* of FIGS. 10A-10G, various views of an example scraper glove 105*x* are shown. For instance, as shown in FIG. 10A, the scraper glove 105*x* may include a scraper element 120*x* attached to the end of the fingers of a mitten-shaped glove section 905 to enable at least the distal phalange of two or more fingers (and up to the entirety of one or more of the fingers) of the user to be placed within and engage the scraper element 120*x*. The scraper element 120*x* may have a substantially flat scraper edge 230 (at the center of the edge) with serrating, teeth, or grooves to enhance the scraping function of the scraper edge. In some implementations, the scraper edge may taper at the ends to provide rounded corners (e.g., 1050, 1055), which transition to side scraping edges (e.g., 1060, 1065) to provide versatile scraping surfaces to reach hard to access sections within the interior of a pumpkin. The scraping edge may be serrated or disposed with teeth 1020 along the upper flat section, the rounded sections, and the side sections of the scraper edge 230. The scraper element 120*x* may additionally include a textured leverage point 1015, which may be implemented using a texture section formed through indentations or embossing on the palmar (or anterior) side of the scraper element between the scraping edge 230 and the bottom of the scraper element (where the opening of the scraper element accepts the fingers of the user). A user may place the thumb 1010 of the scraper glove at the leverage point 1015 to create more leverage in the hand of the user while in the act of scraping to enhance the function of the scraper glove (e.g., in hollowing the interior of a pumpkin). The texturing of the leverage point 1015 may mitigate against the thumb 1010 slipping from this position, thereby undermining the user's ability to maintain the enhanced scraping positioning of their hand (e.g., with the upper portions of the finger pressing forward in the direction of the scrape and the thumb pressing inward toward the fingers (e.g., near the second (neutron) or third (homo) joint of the middle finger)).

Continuing with this example, portions of the glove section 905 may be provided with texturing (e.g., 1005) to enhance the ability of the user to grasp and secure slippering pulp and seeds loosened by the scraper element 120*x* during use of the scraper glove 105*x*. For instance, a section 1005 of the glove section 905 corresponding to the palm of the user's hand may be textured (e.g., formed from the same material (e.g., rubber, latex, nitrile, etc.) as the remainder of the glove section 905). The sleeve section 910, in some implementations, may be long enough to cover the upper forearm and upper arm (e.g., up to the user's shoulder). The sleeve section 910 may be composed of a material that is suitable for printing patterns, logos, or other content, which have utility in marketing and enhancing the appearance of the scraper glove, as well as providing utility in blocking the user's clothing and skin from contact with the innards of the pumpkin (or squash or watermelon), during use.

Figure 10B:
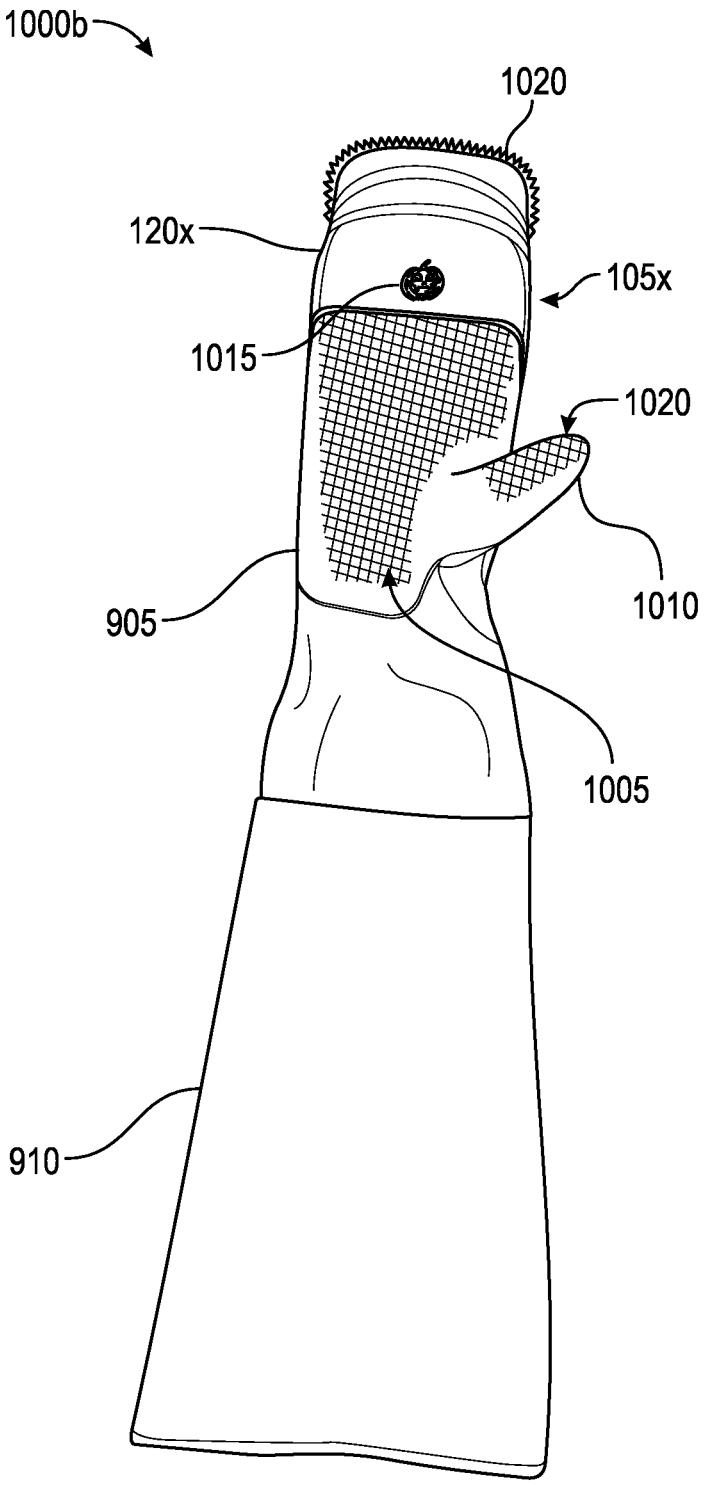
Figure 10C:
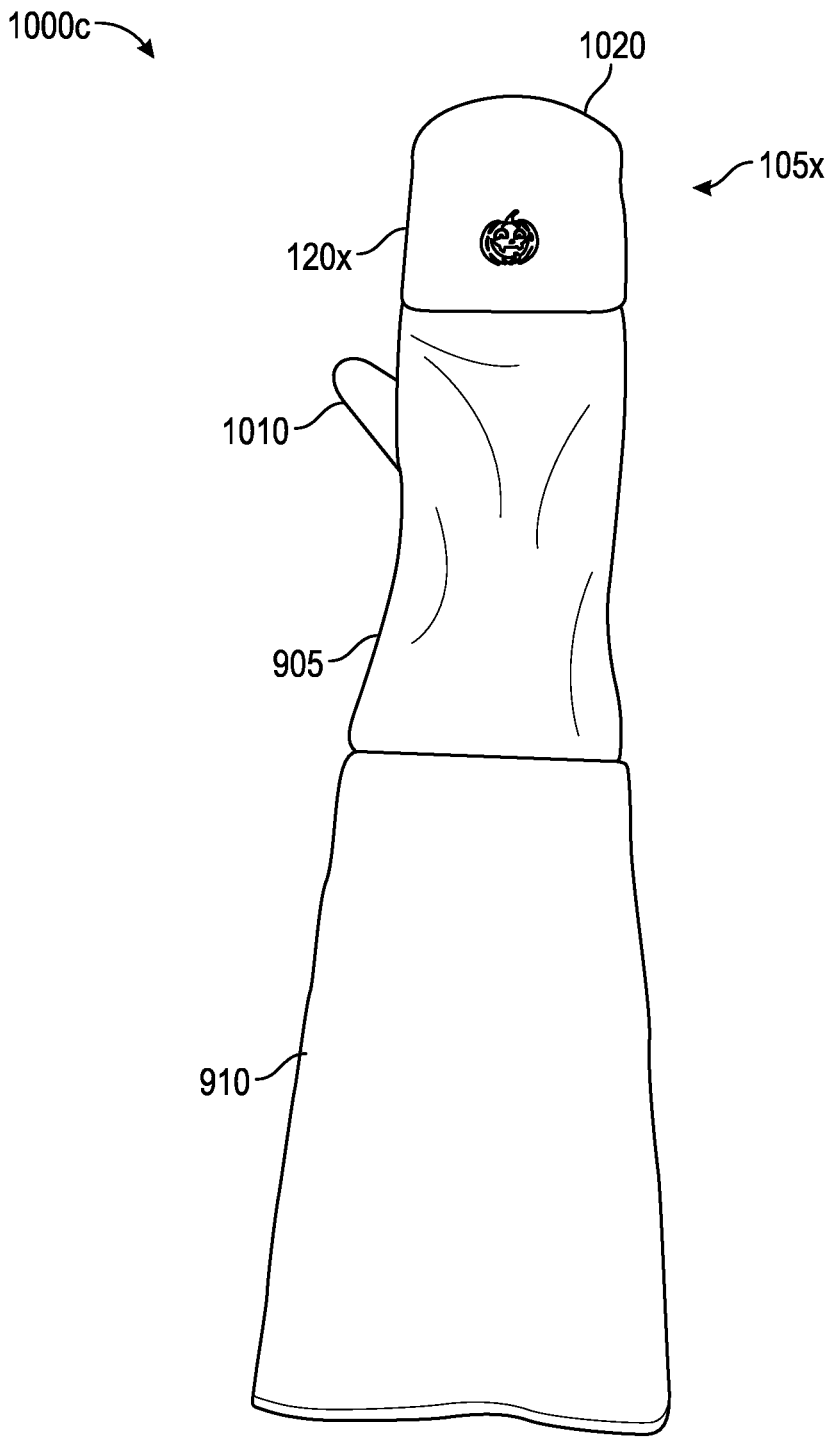

FIG. 10B shows another view 1000*b* of a front or anterior side of the scraper glove 105*x* with the thumb sleeve 1010 extended to reveal additional texturing 1020 provided on the palmer surface of the thumb (e.g., to enhance the user's use of their thumb to secure and remove pulp scraped by the scraper element 120*x*). FIG. 10C shows a view 1000*c* of a back or posterior side of the scraper glove 105*x*. In some implementations, texturing may be omitted from the posterior side of the glove section 905 of the scraper glove 105*x*.

Figure 10D:
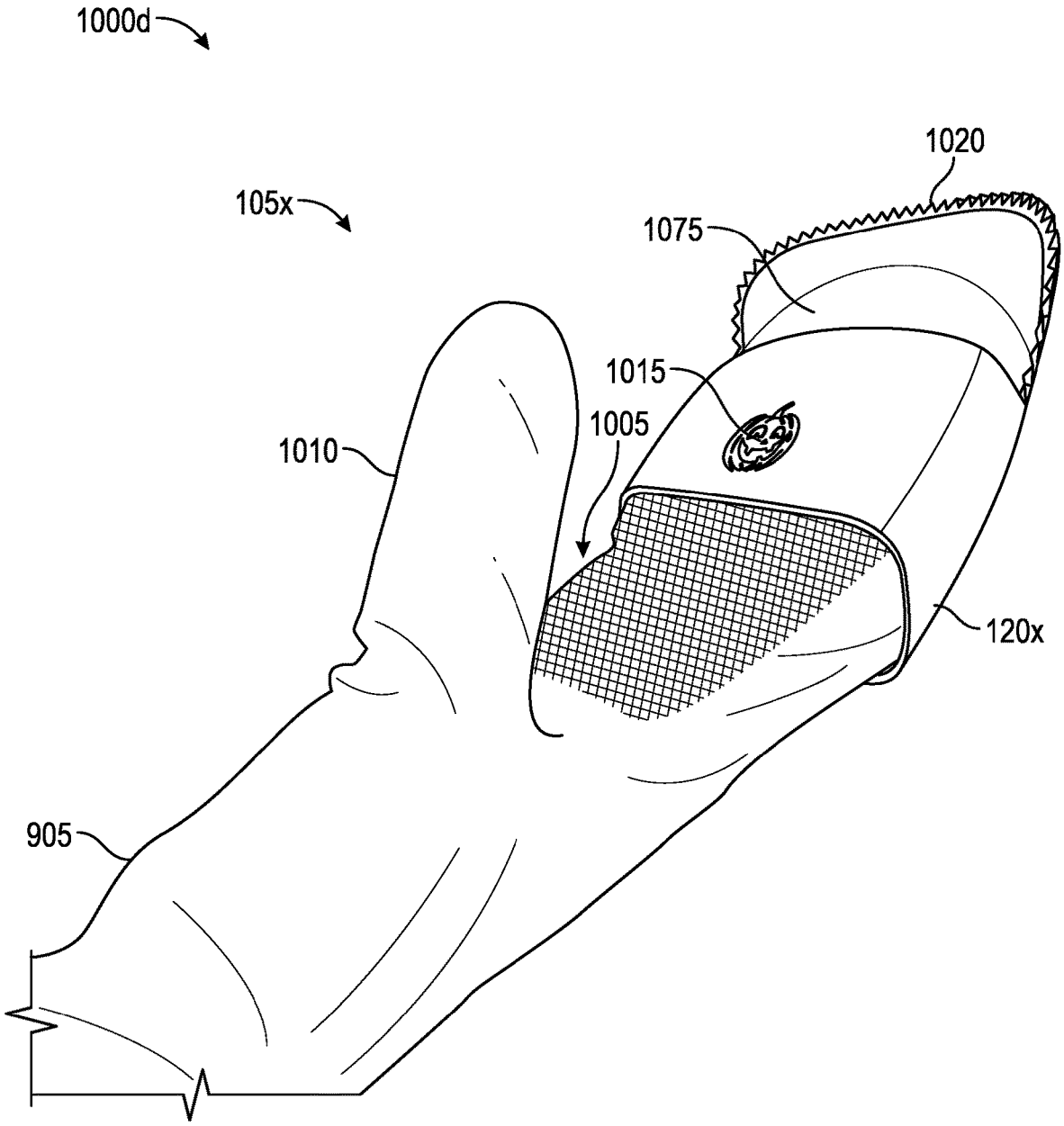
Figure 10E:
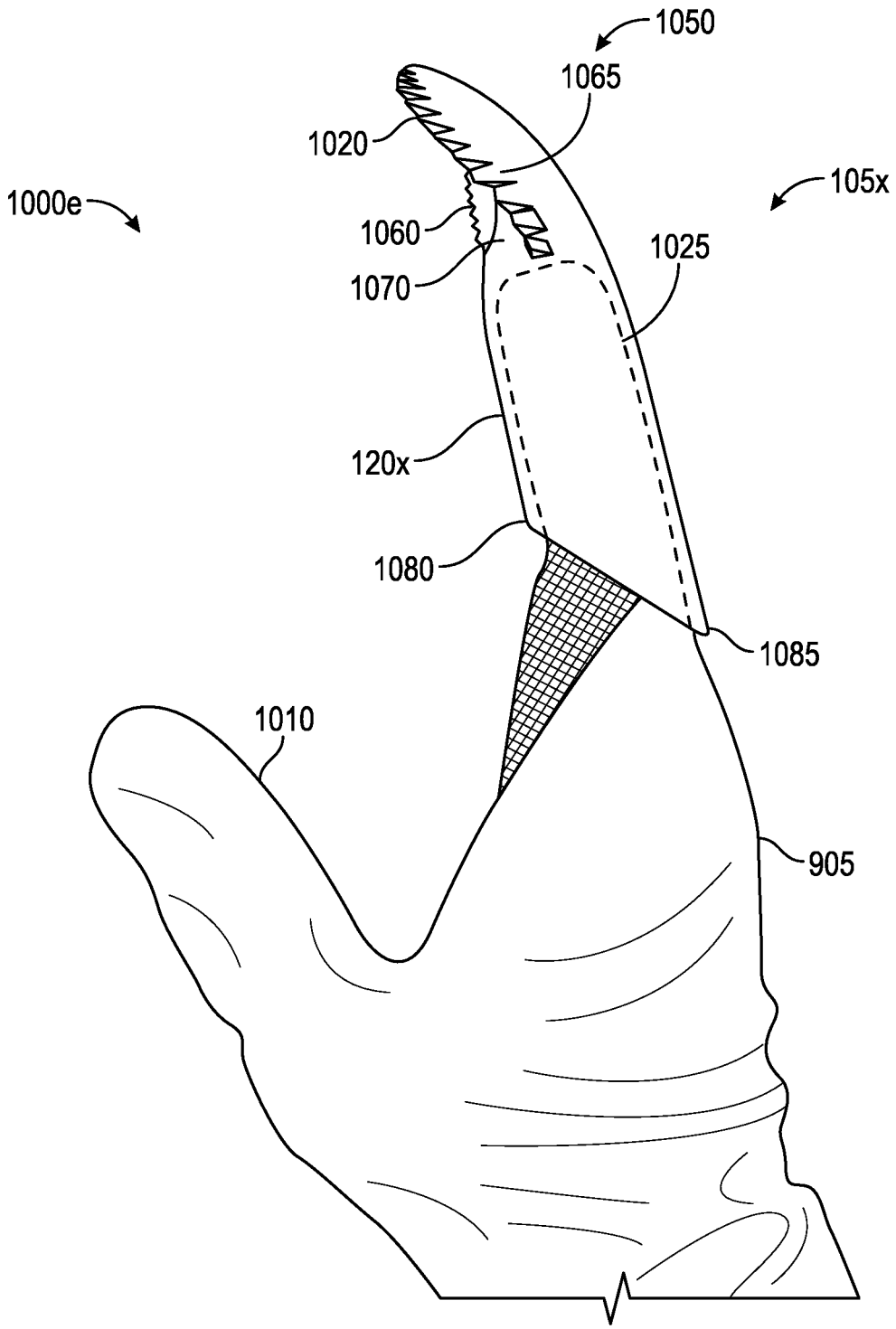
Figure 10F:
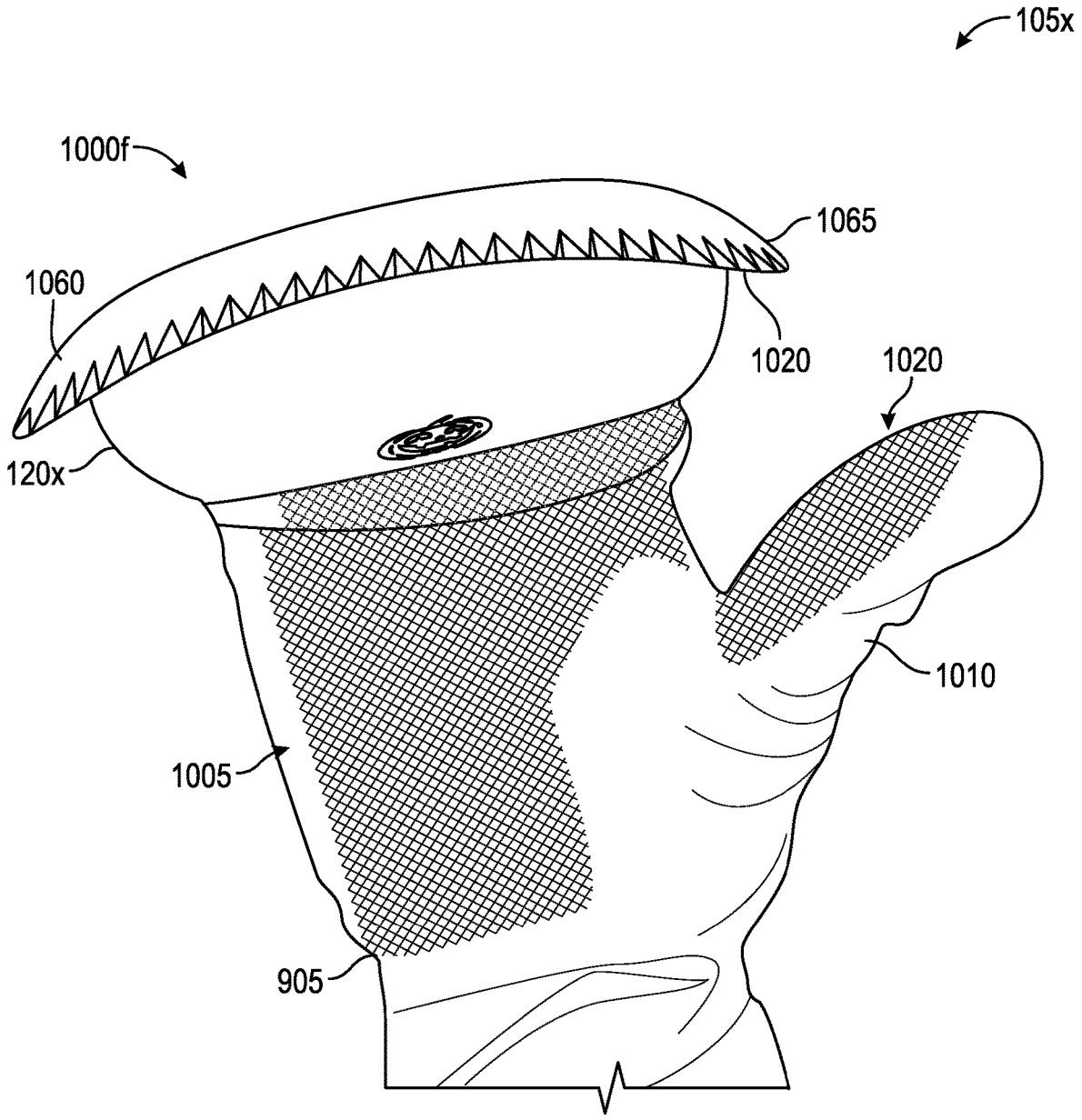

FIG. 10D shows a closer perspective view 1000*d* of glove section 905 and scraper element 120*x* of an example scraper glove 105*x* to highlight the general shape and form of the scraper element and the serrated scraping edge 1020 of the scraper element 120*x*. FIG. 10E shows a side view 1000*e* of the glove section 905 and scraper element 120*x*. FIG. 10F shows a view 1000*f* of the glove section 905 and scraper element 120*x* with the scraper glove flexed by the hand of a user to point the scraper edge toward the viewer and illustrate the contours of the scraper element from a top view. The views of FIGS. 10D-10F combine to show the example exterior geometry of an example scraper element 120*x*. In some implementations, a reinforced transitional section 1075 may be provided from the end of the hollow opening or receptacle in which user fingers are inserted within the scraper element to the scraping edge 1020. The exterior surface of the transitional section may transition smoothly toward the scraping edge 1020 so as not to form crevices in which pulp may build up during scraping. In other implementation, the build up of scraping on the surface of the scraper element may be deliberately facilitated through the contours form on the anterior surface of the scraper element, among other example implementations. In some instances (such as shown in the example of FIGS. 10A-10G, may be formed of solid (i.e., not hollow) material to add reinforced strength to the scraper element 120*x*, which extends from the fingertips of the user (e.g., the resulting force of the scraping causing a lever arm effect at the edge of the scraper element (with the pressure applied by the fingers being the corresponding fulcrum)). The dashed lines 1025 shown in FIG. 10E illustrate the example interior dimension of the interior cavity or receptacle of the scraper element 120*x* for accepting the fingers of the user (and the upper section of the glove section 905 corresponding to the fingers). As shown, the reinforced transitional section may be composed of solid material above the top of the cavity and transitioning along a smooth, gradual curve to the relatively thinner scraper edge section of the scraper element. As further shown in FIG. 10E, the anterior (1080) and posterior (1085) of the interior cavity or receptable of the scraper element 120*x* may be different lengths. For instance, to provide superior leverage for the fingers of the user, the posterior side 1085 of the cavity 1025 may be longer than the anterior side 1080. In other implementations, the lengths of the two sides may be equal, among other example features.

Figure 10G:
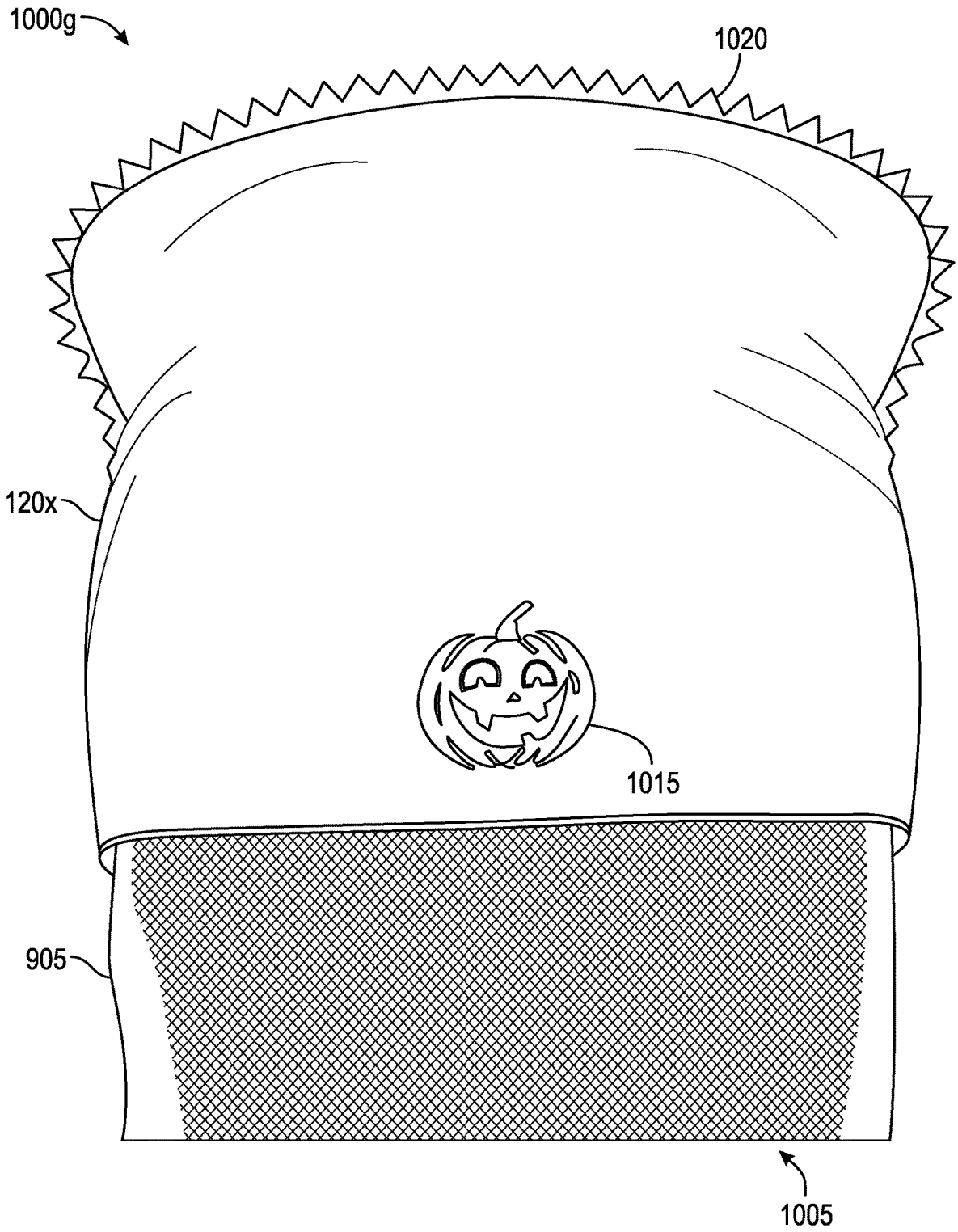
Figure 11A:
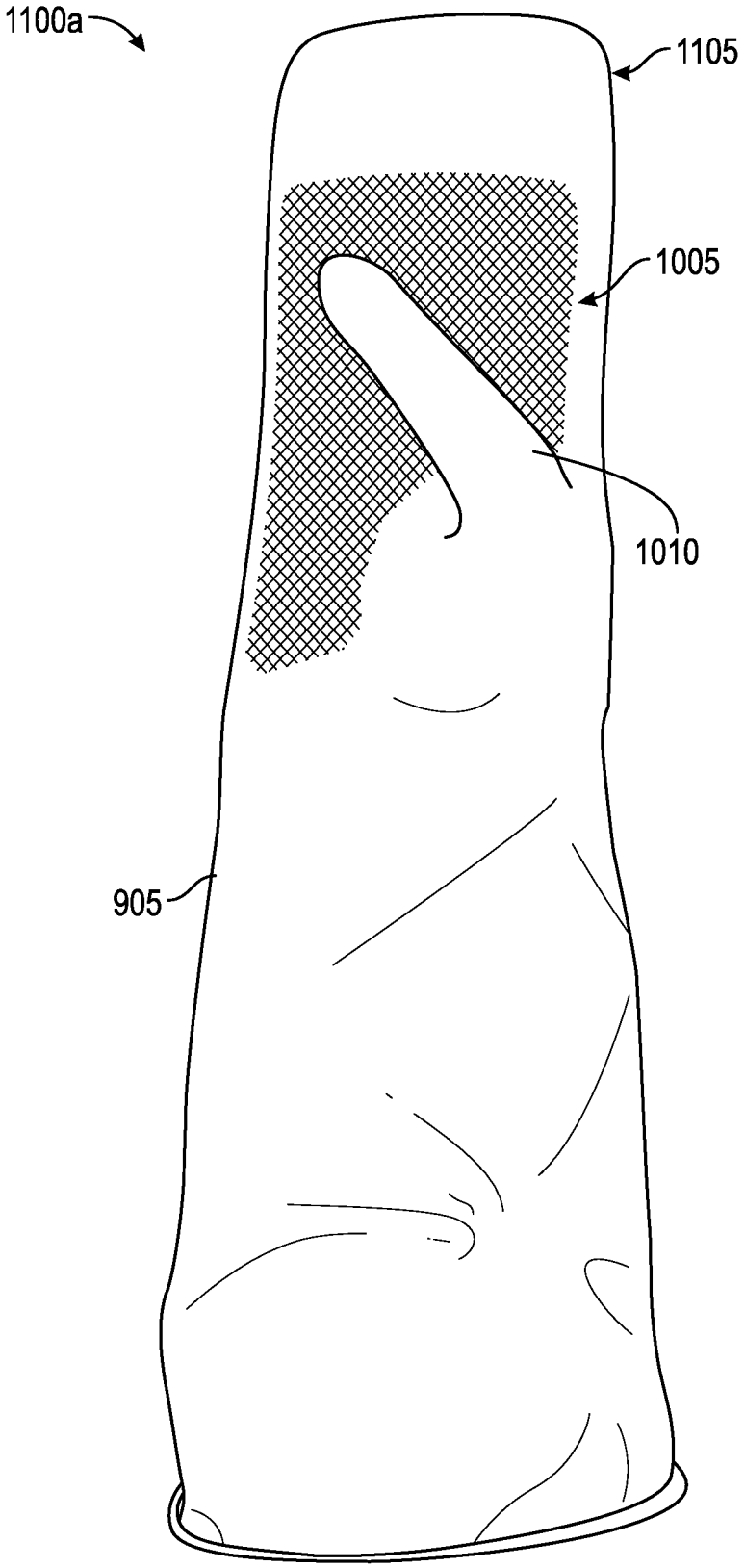
FIGS. 11A-11D illustrate views of an example glove section component for a scraper glove.
Figure 11B:
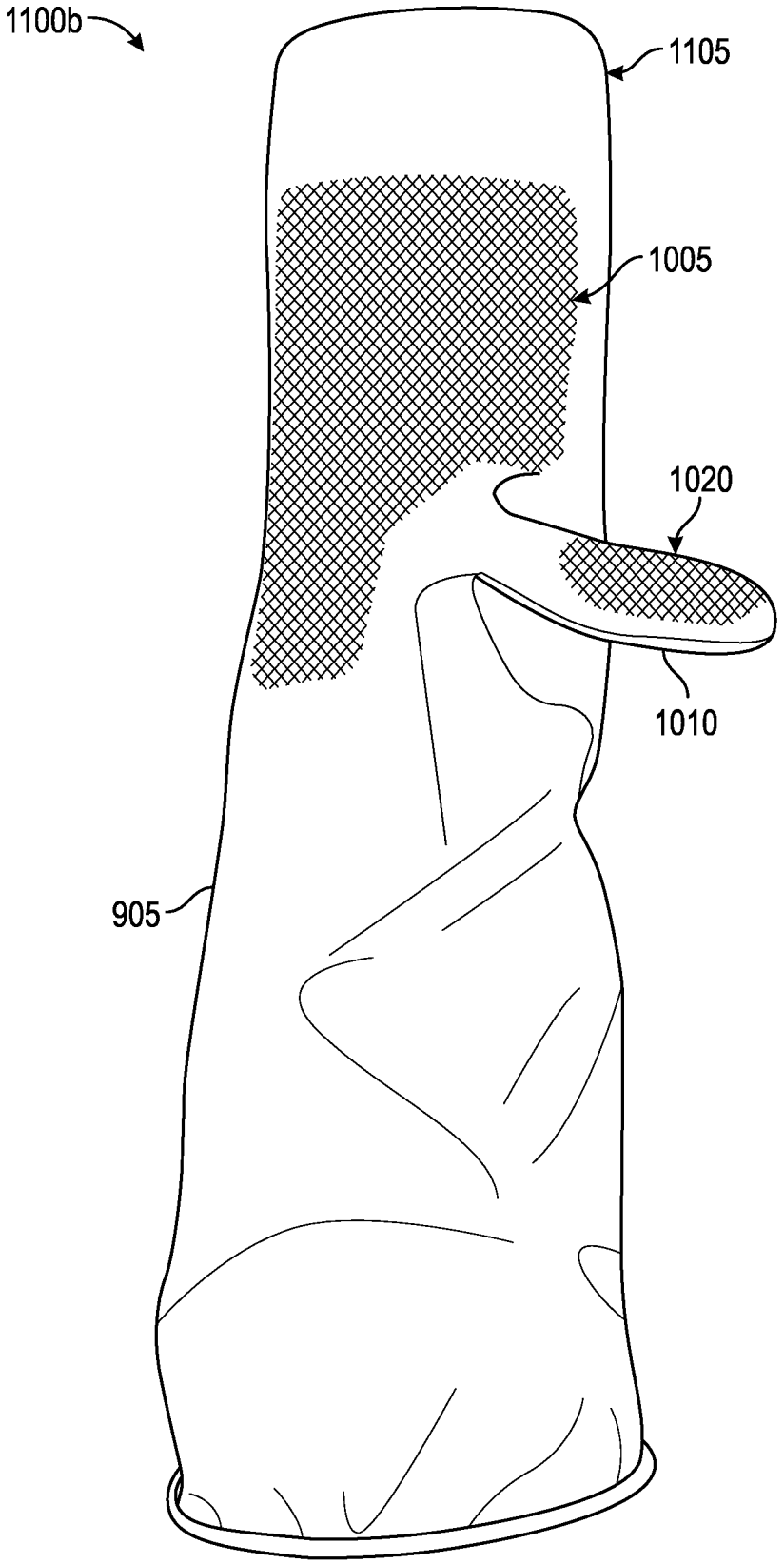
Figure 11C:
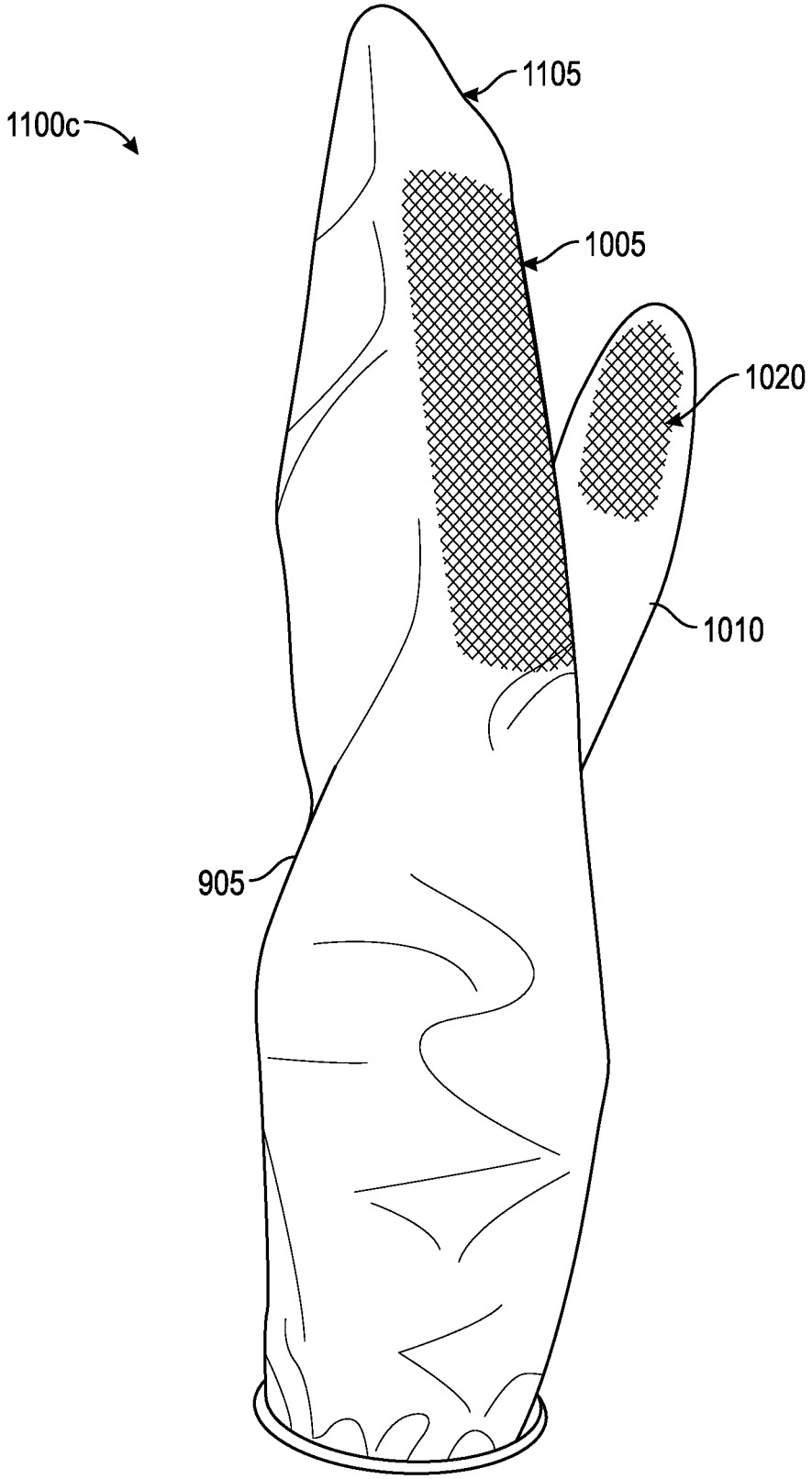
Figure 11D:
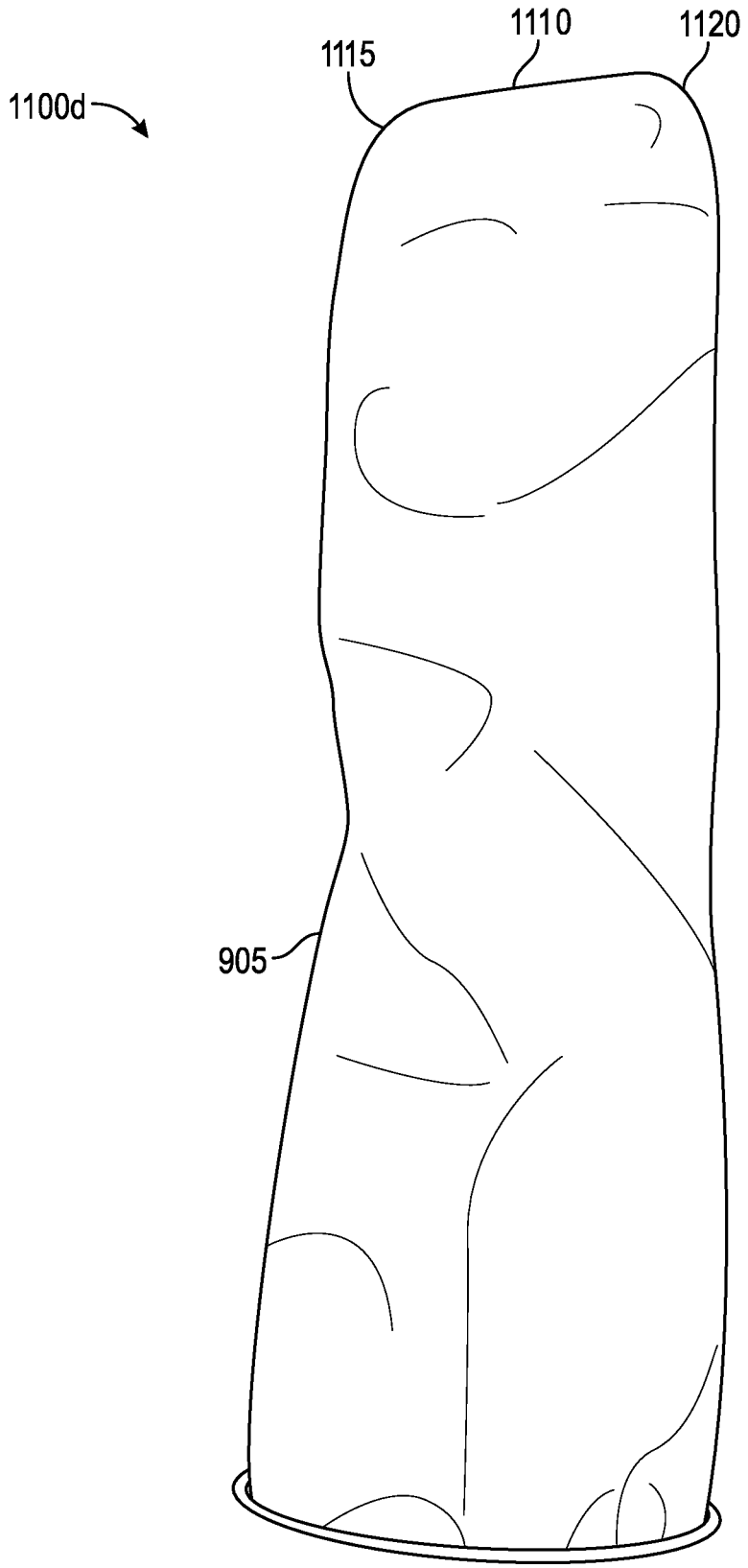

As shown in FIGS. 10E-10G, the scraper edge may have relatively straight sections (at the top and sides of the scraper edge 120*x*), as well as rounded sections. All or a portion of these sections of the scraper edge may be provided with teeth or serrating, or may alternatively be flat (to provide a flat or straight scraping edge). The scraper portion 1050 of the scraper element may also be curved (e.g., as viewed from the sides or top) to encourage the collection of innards (e.g., of a pumpkin) during scraping. For instance, the scraper portion 1050 may be contoured to position the side sections 1060, 1065 forward to form a curve or spoon-like effect or geometry to enhance the scooping and scraping functionality of the scraper element, among other example features and geometries (including those discussed above and combinations of the same). FIG. 10G shows a close-up view 1000*g* of an anterior side of the scraper element illustrated in the example scraper glove of FIGS. 10A-10F.

Turning to FIGS. 11A-11D, views 1100*a-d* of an example glove section 905 are shown prior to be coupled to a sleeve section and a scraper section in the manufacture of a scraper glove. The glove section 905 may be specially manufactured and composed for use as a component of a scraper glove, such as the example scraper glove 105*x* shown and discussed in FIGS. 10A-10F. For instance, textured sections 1005, 1020 may be provided on the anterior surfaces of the palm and thumb 1010 of the glove section 905. Further, rather than having a geometry dictated strictly by the anatomy of a human hand, the glove section may be mitten-like in form with a top geometry 1105 that is formed to correspond to the inner dimensions of the inner cavity of a scraper element to which the glove section 905 is to be bonded. For instance, the top 1110 of the glove section 905 may be substantially flat and rectangular, with rounded corners 1115, 1120 to correspond to a similarly shaped inner cavity of a scraper element. Further, textured sections (e.g., 1005) may be positioned on the glove section 905 to correspond to the dimensions of the scraper element. For instance, texturing may inhibit strong and uniform bonding of the glove section to the surface of the inner cavity of a scraper element. Accordingly, the texturing 1005 for the palm of the glove section may end (and be omitted in top section 1105), so that the surfaces of the glove section that are to be bonded to the inner cavity of a scraper element are adapted (e.g., a smooth surface, roughed surface (but less than the textured surfaces of the glove section), etc.) to maximize surface adhesion or bonding between the glove section and the scraper element, among other example features and considerations. The glove section may be composed of an elastomeric material, such as rubber, latex, nitrile, polyvinyl chloride (PVC) or other material possession elastomeric properties. In some implementations, the sleeve section may be glued or sewn to connect to the glove section and may be composed of a material (e.g., polyester, cotton, nylon, etc.) with less elastomeric properties than the glove section. The scraper element may be glued, heat bonded, or otherwise permanently attached to the top end of the mitten glove section, the scraper element built (e.g., through injection molding, 3D printing, etc.) of a rigid material (e.g., with rigidity greater than that achievable in the material used to construct the glove section), such as a plastic or metal material.

Figure 12:
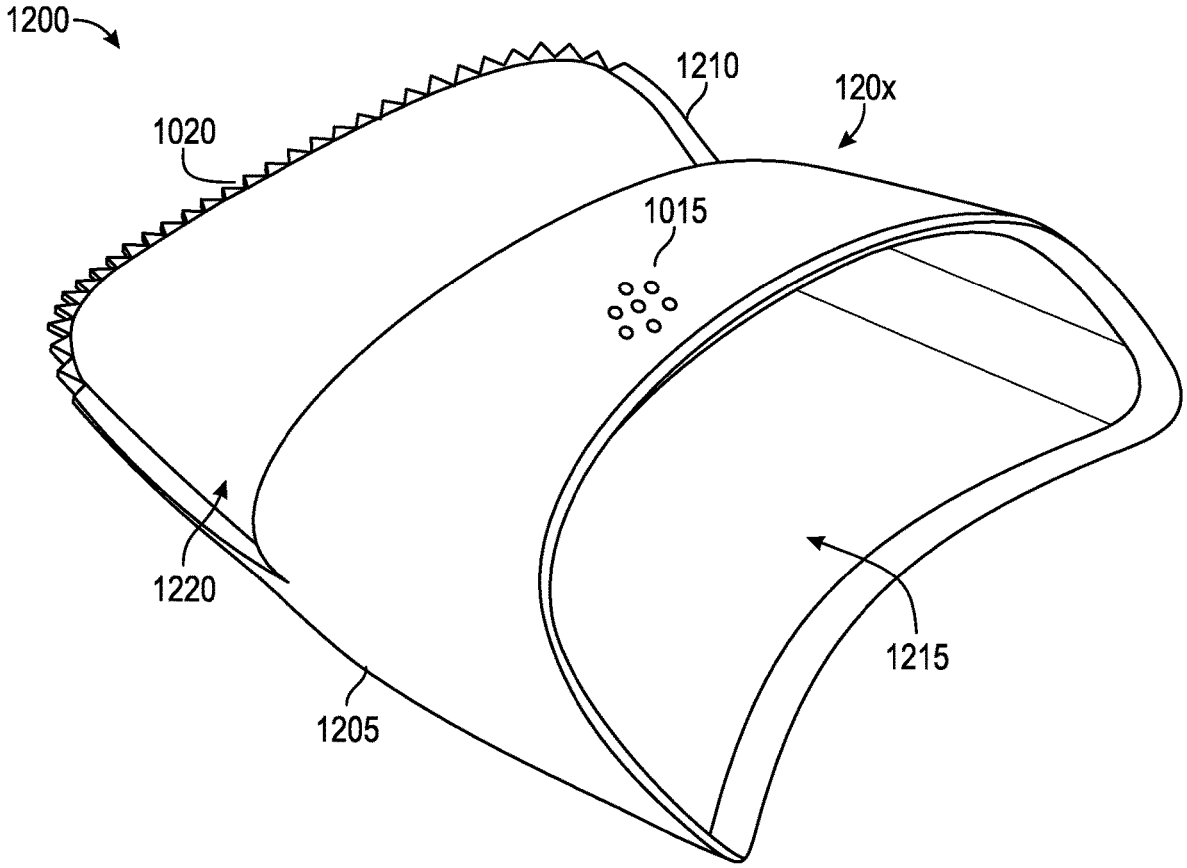
FIG. 12 illustrates an example scraper element component for a scraper glove.

FIG. 12 shows a perspective view 1200 of an example scraper element component (e.g., prior to attachment to a glove section (e.g., the top end 1105 of the glove section 905 shown in FIGS. 11A-D)). In this example, the scraper element is similar to the scraper element in the examples of FIGS. 10A-10G, but with serrating omitted from the side scraping edge sections and the omission of a reinforced transitional section. The scraper element component 1205 may include a scraper section 1210 and an interior cavity (or receptacle) 1215 in which the top end of the glove section 905 is to be inserted and adhered during manufacture of a scraper glove. As noted above, the glove section 905 may be formed (e.g., using a corresponding dip mold) to correlate to the interior dimensions of the interior cavity 1215. While a reinforced transitional section is omitted in this example, this may be purposeful, so as to encourage the accumulation of pulp or other material during scraping (e.g., within a groove 1220 formed where the scraper section 1210 meets the top exterior surface of the interior cavity 1215). As introduced above, straight and serrated sections of the scraping element may be advantageously used exclusively or in combination based on the scraping application. A leverage point 1015 may also be formed (e.g., based on a corresponding mold used to manufacture the scraper element component) to provide texture and a target for a user to maximize leverage during user. A variety of textured patterns may be alternatively used to provide this textured leverage point 1015 (e.g., including text or graphics, which may instruct a user to position the thumb at this point or for use in branding or enhancing the aesthetics of the scraper glove, among other example advantages and considerations). It should be appreciated that the various figures and features illustrated and described in this document may be combined and sub-combined in implementations of an example scraper glove and that such embodiments are within the scope of the solutions and apparatus discussed herein.

Accordingly, several example embodiments have been described in the present Specification. Additional combinations and sub-combinations may also be realized without diverging from the subject matter of the present disclosure. For instance, Example 1 is an article including: a scraper glove including: a glove body including one or more finger sleeves; and one or more scraper elements, where each of the scraper elements includes: a receptacle portion positioned within a respective one of the finger sleeves to accept one or more fingers of a user; and a scraping portion including one or more scraping edges extending from a tip of the corresponding finger sleeve and integrally connected to the corresponding receptacle portion, where the scraping portion is configured to scrape a plant-based medium.

Example 2 includes the subject matter of Example 1, where the glove body includes a glove body made of an elastomeric material.

Example 3 includes the subject matter of Example 2, where the elastomeric material includes at least one of nitrile, latex, silicon, or rubber.

Example 4 includes the subject matter of any one of Examples 2-3, where the scraping element is made of a material more rigid than the elastomeric material Example 5 includes the subject matter of Example 4, where the material of the scraping element includes a rigid plastic.

Example 6 includes the subject matter of any one of Examples 1-5, where the one or more finger sleeves consists of one finger sleeve.

Example 7 includes the subject matter of any one of Examples 1-5, where the one or more finger sleeves consist of two finger sleeves.

Example 8 includes the subject matter of any one of Examples 1-5, where the one or more finger sleeves consist of three finger sleeves.

Example 9 includes the subject matter of any one of Examples 1-5, where the one or more finger sleeves consist of four finger sleeves.

Example 10 includes the subject matter of any one of Examples 1-5, where the one or more finger sleeves consist of five finger sleeves.

Example 11 includes the subject matter of any one of Examples 1-10, where each of the one or more finger sleeves is coupled to a respective scraping element.

Example 12 includes the subject matter of any one of Examples 1-11, where the one or more fingers sleeves includes a plurality of finger sleeves.

Example 13 includes the subject matter of any one of Examples 1-12, where the scraping elements are connected to less than all of the plurality of finger sleeves.

Example 14 includes the subject matter of Example 13, further including a webbing section between at least one pair of adjacent finger sleeves in the plurality of finger sleeves.

Example 15 includes the subject matter of Example 14, where a respective webbing section joins each pair of adjacent finger sleeves in the plurality of finger sleeves.

Example 16 includes the subject matter of any one of Examples 14-15, where the webbing includes a lip formed along a top edge of the webbing.

Example 17 includes the subject matter of any one of Examples 14-16, where the webbing includes one or more openings.

Example 18 includes the subject matter of Example 17, where the webbing includes a mesh-like webbing.

Example 19 includes the subject matter of any one of Examples 14-18, where the webbing section is formed integrally with and of the same material as the pair of adjacent finger sleeves.

Example 20 includes the subject matter of any one of Examples 14-18, where the webbing section is formed of a material different from the materials of the pair of adjacent finger sleeves Example 21 includes the subject matter of Example 20, where the webbing section is formed of the same material as a scraper element connected to at least one of the pair of adjacent finger sleeves Example 22 includes the subject matter of Example 21, where the webbing section is integrally connected to the scraper element connected to at least one of the pair of adjacent finger sleeves.

Example 23 includes the subject matter of any one of Examples 1-22, where at least a particular one of the one or more scraper elements includes a rib.

Example 24 includes the subject matter of Example 23, where the particular scraper element includes a plurality of ribs.

Example 25 includes the subject matter of any one of Examples 23-24, where at least one of the ribs protrudes from a surface of the particular scraper element near a top scraping edge of the particular scraper element.

Example 26 includes the subject matter of any one of Examples 23-25, where at least one of the ribs extends from the tip of the particular finger sleeve to the scraping edge of the particular scraper element.

Example 27 includes the subject matter of any one of Examples 1-26, where at least one of the scraper elements includes a protrusion and is to connect to a corresponding one of the finger sleeves by positioning the protrusion within a recess formed in the finger sleeve.

Example 28 includes the subject matter of any one of Examples 1-26, where at least one of the scraper elements includes a recess and is to connect to a corresponding one of the finger sleeves by positioning a protrusion formed in the finger sleeve within the recess formed in the scraper element.

Example 29 includes the subject matter of any one of Examples 1-28, where a top scraping edge of at least one of the scraper elements is linear.

Example 30 includes the subject matter of any one of Examples 1-29, where a top scraping edge of at least one of the scraper elements is curved.

Example 31 includes the subject matter of any one of Examples 1-30, where at least one of the scraper elements curves from the tip of the corresponding finger sleeve to a top scraping edge of the scraper element.

Example 32 includes the subject matter of any one of Examples 1-31, where at least one of the scraper elements extends linearly from the from the tip of the corresponding finger sleeve to a top scraping edge of the scraper element.

Example 33 includes the subject matter of any one of Examples 1-32, where at least one scraping edge of at least one of the scraper element is scalloped or serrated.

Example 34 includes the subject matter of Example 33, where the at least one scraping edge includes a top scraping edge of the scraper element.

Example 35 includes the subject matter of Example 33, where the at least one scraping edge includes a side scraping edge of the scraper element.

Example 36 includes the subject matter of any one of Examples 1-35, where the scraper glove includes an opening configured to tighten around an arm of the user.

Example 37 includes the subject matter of any one of Examples 1-36, further including an apron coupled to the scraper glove.

Example 38 includes the subject matter of any one of Examples 1-37, wherein at least one of the scraper elements is a flared scraper element.

Example 39 is a method to manufacture the article of any one of Examples 1-38.

Example 40 is a method to use the article of any one of Examples 1-38.

Example 41 is a method including: attaching a scraper element to a finger sleeves of a glove, where the scraper element includes: a receptacle portion positioned within a respective one of the finger sleeves to accept one or more fingers of a user; and a scraping portion including one or more scraping edges extending from a tip of the corresponding finger sleeve and integrally connected to the corresponding receptacle portion, where the scraping portion is configured to scrape a plant-based medium.

Example 42 includes the subject matter of Example 41, where attaching the scraper element to the finger sleeve includes adhering the scraper element to an interior surface of the finger sleeve.

Example 43 includes the subject matter of Example 41, where attaching the scraper element to the finger sleeve includes forming the finger sleeve over the scraper element.

Example 44 includes the subject matter of Example 41, where attaching the scraper element to the finger sleeve includes forming the finger sleeve within an interior surface of the receptacle.

Example 45 includes the subject matter of Example 44, where attaching the scraper element to the finger sleeve further includes forming the finger sleeve over an exterior surface of the receptacle.

Example 46 is an article including: a scraper glove including: a mitten-shaped glove body including a thumb sleeve to accept a thumb of a human user and a fingers sleeve to accept two or more fingers of the human user; and a scraper element attached to an exterior surface of the fingers sleeve, where the scraper element includes: a receptacle portion, where the exterior surface of the fingers sleeve is attached to a surface of the receptacle portion, and the receptacle portion is to accept one or more fingers of a user when positioned within the fingers sleeve; a scraping portion extending from the receptacle portion and integrally connected to the receptacle portion, where the scraping portion includes a scraping edge including one or more teeth, and the scraping edge is configured to scrape pulp of a plant-based medium to hollow-out the plant-based medium; and a textured leverage point on an anterior external surface of the scraper element between an end of the receptacle portion and the scraping edge.

Example 47 includes the subject matter of Example 46, where the glove body is made of an elastomeric material.

Example 48 includes the subject matter of Example 47, where the elastomeric material includes at least one of nitrile, latex, silicon, or rubber.

Example 49 includes the subject matter of Example 47, where the scraping element is made of a material more rigid than the elastomeric material.

Example 50 includes the subject matter of any one of Examples 46-49, where an anterior external surface of the thumb sleeve is textured and a portion of an anterior external surface of a palm section of the glove body is textured.

Example 51 includes the subject matter of Example 50, where at least a portion of the anterior external surface of the glove body is untextured.

Example 52 includes the subject matter of Example 51, where the portion of the anterior external surface corresponds to an external surface of the fingers sleeve covered by the attached scraper element.

Example 53 includes the subject matter of any one of Examples 46-52, where an anterior external surface of the scraper element includes a textured leverage point.

Example 54 includes the subject matter of any one of Examples 46-53, where the textured leverage point includes an embossed pattern.

Example 55 includes the subject matter of any one of Examples 46-53, where the textured leverage point includes a recessed pattern.

Example 56 includes the subject matter of any one of Examples 46-55, where the textured leverage point is to provide friction for placement of the thumb sleeve on the textured leverage point during use of the scraper glove.

Example 57 includes the subject matter of any one of Examples 46-56, where the scraper element is adhered to the glove body by glue.

Example 58 includes the subject matter of any one of Examples 46-57, further including an arm sleeve segment coupled to an opening of the glove body to at least partially cover an upper arm of the human user when wearing the scraper glove.

Example 59 includes the subject matter of Example 58, where the arm sleeve segment is made of a different material than the glove body.

Example 60 includes the subject matter of any one of Examples 46-59, where the scraping edge includes a serrated edge.

Example 61 includes the subject matter of Example 60, where the scraping edge includes a top section, two side sections, and two rounded sections joining the top section to each of the two side sections, where the top section, the two side sections, and the two rounded sections form a continuous edge.

Example 62 includes the subject matter of Example 61, where at least one of the top section, the two side sections, or the two rounded sections includes a straight, non-serrated edge section.

Example 63 includes the subject matter of Example 61, where the top section, the two side sections, and the two rounded sections are all serrated edge sections.

Example 64 includes the subject matter of any one of Examples 46-63, further including a solid reinforced transitional section at a top end of the receptacle portion and forming a smooth transitional surface between the receptacle portion and the scraping edge.

Example 65 includes the subject matter of any one of Examples 46-64, where a posterior side of the receptacle portion of the scraper element is longer than an anterior side of the receptacle portion of the scraper element.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of any means or step plus function elements in the claims below are intended to include any disclosed structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The aspects of the disclosure herein were chosen and described in order to best explain the principles of the disclosure and the practical application, and to enable others of ordinary skill in the art to understand the disclosure with various modifications as are suited to the particular use contemplated.

The invention claimed is:

1. An article comprising:

a scraper glove comprising:

a mitten-shaped glove body comprising a thumb sleeve configured to accept a thumb of a human user and a fingers sleeve to accept two or more fingers of the human user; and a scraper element attached to an exterior surface of the fingers sleeve, wherein the scraper element comprises:

a receptacle portion, wherein the exterior surface of the fingers sleeve is attached to a surface of the receptacle portion, and the receptacle portion is to accept one or more fingers of a user when positioned within the fingers sleeve;

a scraping portion extending from the receptacle portion and integrally connected to the receptacle portion, wherein the scraping portion comprises a scraping edge comprising one or more teeth, and the scraping edge is configured to scrape pulp of a plant-based medium to hollow-out the plant-based medium; and a textured leverage point on an anterior external surface of the scraper element between an end of the receptacle portion and the scraping edge.

2. The article of claim 1, wherein the glove body is made of an elastomeric material.

3. The article of claim 2, wherein the elastomeric material comprises at least one of nitrile, latex, silicon, or rubber.

4. The article of claim 2, wherein the scraping element is made of a material more rigid than the elastomeric material.

5. The article of claim 1, wherein an anterior external surface of the thumb sleeve is textured and a portion of an anterior external surface of a palm section of the glove body is textured.

6. The article of claim 5, wherein at least a portion of the anterior external surface of the glove body is untextured.

7. The article of claim 6, wherein the portion of the anterior external surface corresponds to an external surface of the fingers sleeve covered by the attached scraper element.

8. The article of claim 1, wherein an anterior external surface of the scraper element comprises a textured leverage point.

9. The article of claim 1, wherein the textured leverage point comprises an embossed pattern.

10. The article of claim 1, wherein the textured leverage point comprises a recessed pattern.

11. The article of claim 1, wherein the textured leverage point is to provide friction for placement of the thumb sleeve on the textured leverage point during use of the scraper glove.

12. The article of claim 1, wherein the scraper element is adhered to the glove body by glue.

13. The article of claim 1, further comprising an arm sleeve segment coupled to an opening of the glove body to at least partially cover an upper arm of the human user when wearing the scraper glove.

14. The article of claim 13, wherein the arm sleeve segment is made of a different material than the glove body.

15. The article of claim 1, wherein the scraping edge comprises a serrated edge.

16. The article of claim 15, wherein the scraping edge comprises a top section, two side sections, and two rounded sections joining the top section to each of the two side sections, wherein the top section, the two side sections, and the two rounded sections form a continuous edge.

17. The article of claim 16, wherein at least one of the top section, the two side sections, or the two rounded sections comprises a straight, non-serrated edge section.

18. The article of claim 16, wherein the top section, the two side sections, and the two rounded sections are all serrated edge sections.

19. The article of claim 1, further comprising a solid reinforced transitional section at a top end of the receptacle portion and forming a smooth transitional surface between the receptacle portion and the scraping edge.

20. The article of claim 1, wherein a posterior side of the receptacle portion of the scraper element is longer than an anterior side of the receptacle portion of the scraper element.

* * * * *